US005848387A

United States Patent [19]

Nishiguchi et al.

[11] Patent Number: 5,848,387

[45] Date of Patent: Dec. 8, 1998

[54] PERCEPTUAL SPEECH CODING USING PREDICTION RESIDUALS, HAVING HARMONIC MAGNITUDE CODEBOOK FOR VOICED AND WAVEFORM CODEBOOK FOR UNVOICED FRAMES

[75] Inventors: Masayuki Nishiguchi, Kanagawa; Kazuyuki Iijima, Saitama; Jun Matsumoto; Shiro Omori, both of Kanagawa, all of Japan

[73] Assignee: Sony Corporation, Tokyo, Japan

[21] Appl. No.: 736,987

[22] Filed: Oct. 25, 1996

[30] Foreign Application Priority Data

Oct. 26, 1995 [JP] Japan ..... 7-279412

[51] Int. Cl.[6] ..... G10L 9/14

[52] U.S. Cl. ..... 704/214; 704/219; 704/220; 704/223

[58] Field of Search ..... 704/214, 219, 704/220, 222, 223

[56] References Cited

U.S. PATENT DOCUMENTS

| | | | |
|---|---|---|---|
| 5,067,158 | 11/1991 | Arjmand | 704/219 |
| 5,495,555 | 2/1996 | Swaminathan | 704/207 |
| 5,596,676 | 1/1997 | Swaminathan et al. | 704/208 |

FOREIGN PATENT DOCUMENTS

| | | | |
|---|---|---|---|
| 5-265496 | 10/1993 | Japan | G10L 9/14 |
| 5-265499 | 10/1993 | Japan | G10L 9/18 |
| 6-222797 | 8/1994 | Japan | G10L 9/14 |

OTHER PUBLICATIONS

Kazunori Ozawa and Toshiki Miyano, "4kb/s Improved CELP Coder With Efficient Vector Quantization", Proc. ICASSP 91, pp. 213–216, Apr. 1991.

Kazunori Ozawa, Masahiro Serizawa, Toshiki Miyano, and Toshiyuki Nomura, "M–LCELP Speech Coding at 4Kbps", Proc. ICASSP 94, vol. I, pp. 269–272, Apr. 1994.

*Primary Examiner*—David R. Hudspeth
*Assistant Examiner*—Tālivaldis Ivars Šmits
*Attorney, Agent, or Firm*—Jay H. Maioli

[57] ABSTRACT

A speech encoding method and apparatus for encoding an input speech signal on a block-by-block or frame-by-frame basis wherein short-term prediction residuals are found and then sinusoidal analytic encoding parameters are produced based on those short-term prediction residuals. Perceptually weighted vector quantization is performed for voiced blocks or frames by encoding their sinusoidal frequency or analytic harmonic magnitudes and, in the case of unvoiced blocks or frames, the time waveforms of the unvoiced blocks are encoded.

8 Claims, 13 Drawing Sheets

PERCEPTUAL SPEECH CODING USING PREDICTION RESIDUALS, HAVING HARMONIC MAGNITUDE CODEBOOK FOR VOICED AND WAVEFORM CODEBOOK FOR UNVOICED FRAMES

BACKGROUND OF THE INVENTION

1. Field of the Invention

This invention relates to a speech encoding method and apparatus in which an input speech signal is divided on a block basis and encoded in terms of units of the resulting blocks.

2. Description of the Related Art

There have hitherto been known a variety of encoding methods for encoding an audio signal, which is inclusive of speech and acoustic signals, using compression that exploits the statistical properties of the signals in the time domain and in the frequency domain, and that also utilizes the psychoacoustic characteristics of the human hearing physiology. These encoding methods may roughly be classified into time-domain encoding, frequency domain encoding, and analysis/synthesis encoding.

In addition there are known methods of high-efficiency encoding of speech signals that include sinusoidal analysis encoding, such as harmonic encoding, multi-band excitation (MBE) encoding, sub-band coding (SBC), linear predictive coding (LPC), discrete cosine transform (DCT), modified DCT (MDCT), and fast Fourier transform (FFT).

With the speech signal encoding apparatus employing high-efficiency encoding of speech signals, short-term prediction residuals, such as residuals of linear predictive coding (LPC), are encoded using sinusoidal analysis encoding, and the resulting amplitude data of the spectral envelope is vector-quantized for producing output codebook index data.

With the above-described speech signal encoding apparatus, the bit rate of the encoding data including the codebook indices of the vector quantization remains constant and cannot be varied.

Moreover, if the encoding data is M bits, for example, the speech signal decoding apparatus for decoding the encoded data needs to be an M-bit decoding apparatus. That is, with the speech signal decoding apparatus, only decoded data having the same number of bits as the encoded data can be obtained, while the number of bits of the decoded data cannot be varied.

SUMMARY OF THE INVENTION

It is therefore an object of the present invention to provide a speech encoding method and apparatus whereby the bit rate of the encoding data can be varied.

With the speech encoding method and apparatus according to the present invention, short-term prediction residuals are found for at least the voiced portion of the input speech signal and sinusoidal analytic encoding parameters are found based on the short term prediction residuals. These sinusoidal analytic encoding parameters are quantized by perceptually weighted vector quantization. The unvoiced portion of the input speech signal is encoded by waveform coding with phase reproducibility. In the perceptually weighted vector quantization, a first vector quantization is carried out, and the quantization error vector produced at the time of the first vector quantization is quantized by a second vector quantization. In this manner, the number of bits of the output encoded data can be easily switched depending on the capacity of the data transmission channels so that plural data bit rates can be coped with. In addition, such encoded data string may be generated that can be easily coped with on the decoder side, even if the bit rate differs between the encoder and the decoder.

DETAILED DESCRIPTION OF THE PREFERRED EMBODIMENTS

Figure 1:
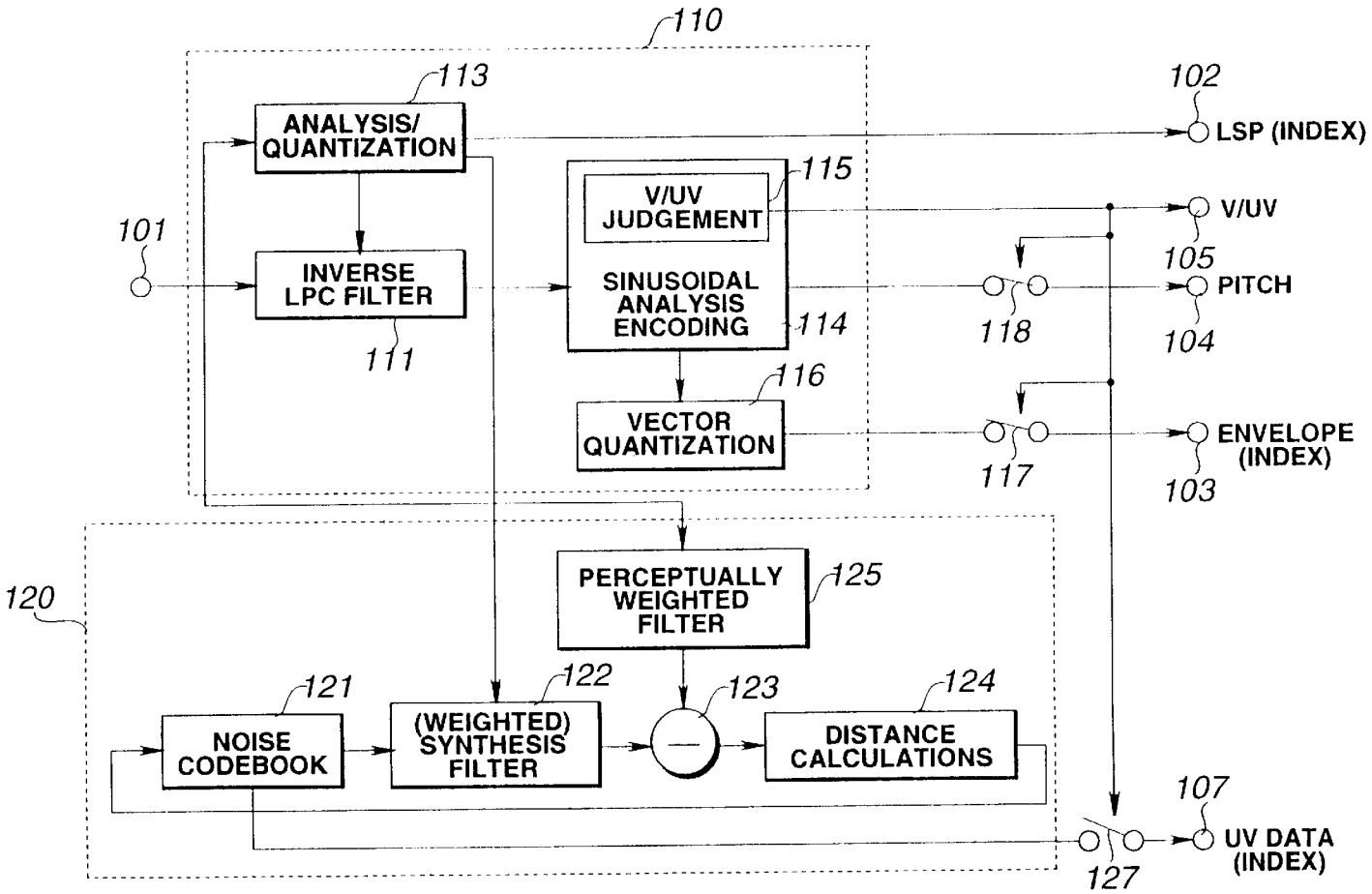
FIG. 1 is a block diagram of a speech signal encoding apparatus (encoder) for carrying out the encoding method according to an embodiment of the present invention.

Referring to the drawings, preferred embodiments of the present invention will be explained in detail.

In FIG. 1, there is shown in block diagram form a basic structure of a speech signal encoder for carrying out the speech encoding method according to an embodiment of the present invention. The speech signal encoder includes an inverse LPC filter 11 for finding short-term prediction residuals of input speech signals fed in at input terminal 101, and a sinusoidal analytic encoder 114 for finding sinusoidal analysis encoding parameters from the short-term prediction residuals output by the inverse LPC filter 111. The speech signal encoder also includes a vector quantization unit 116 for performing perceptually weighted vector quantization on the sinusoidal analytic encoding parameters output by the sinusoidal analytic encoder 114. A second encoding unit 120 is provided for encoding the input speech signal by phase transmission waveform encoding.

Figure 2:
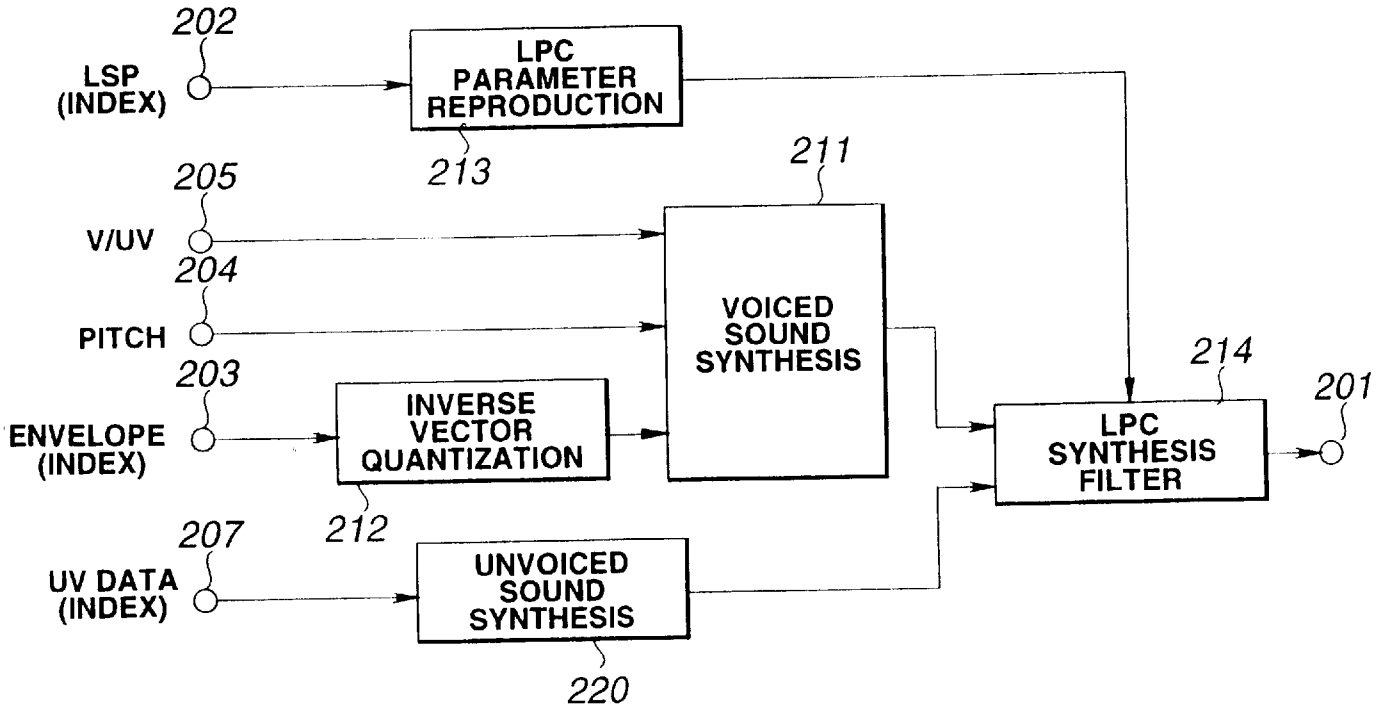
FIG. 2 is a block diagram of a speech signal decoding apparatus (decoder) for carrying out the decoding method for decoding a signal encoded by the apparatus shown in FIG. 1.
Figure 3:
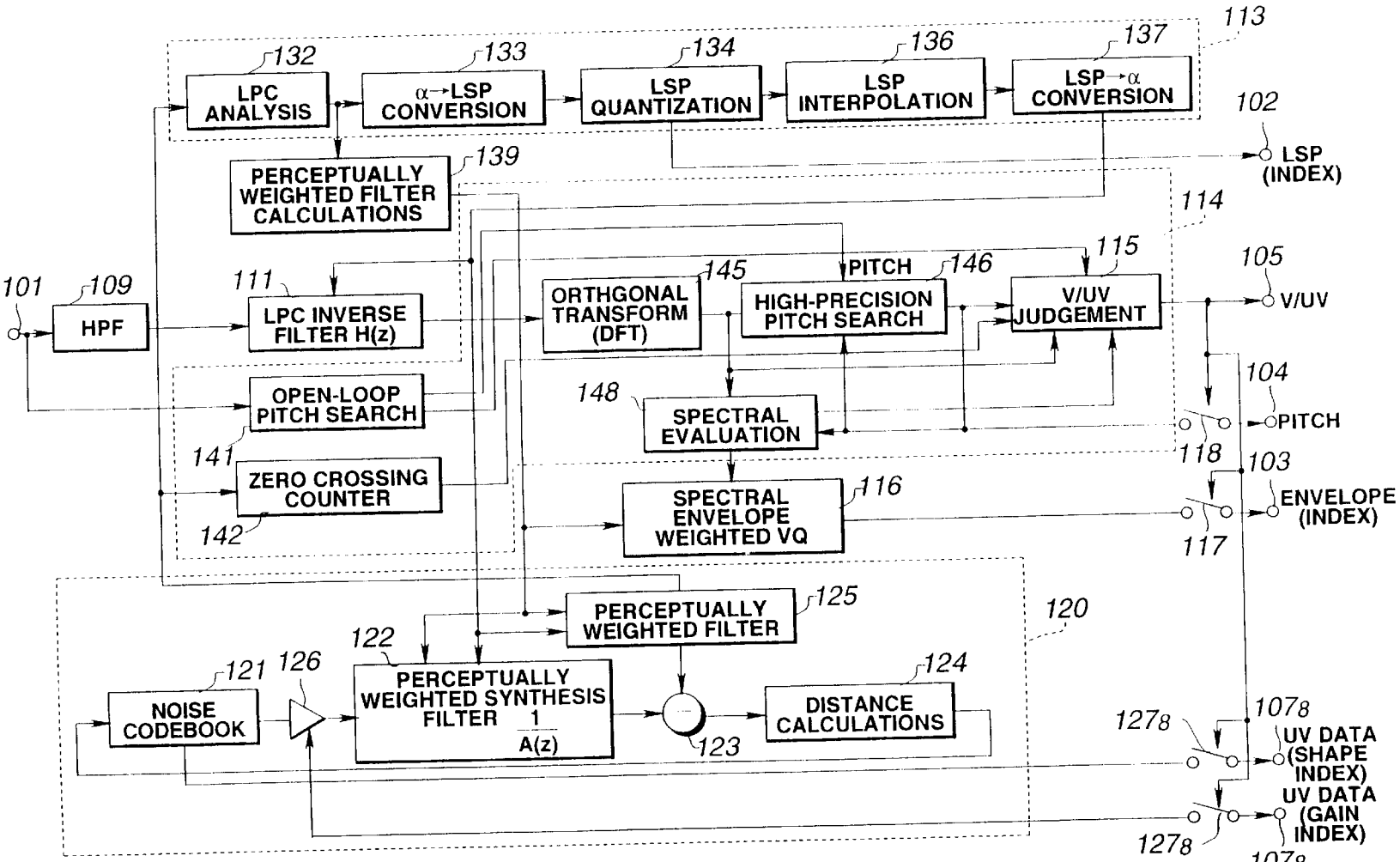
FIG. 3 is a block diagram showing in more detail the speech signal encoder shown in FIG. 1.
Figure 4:
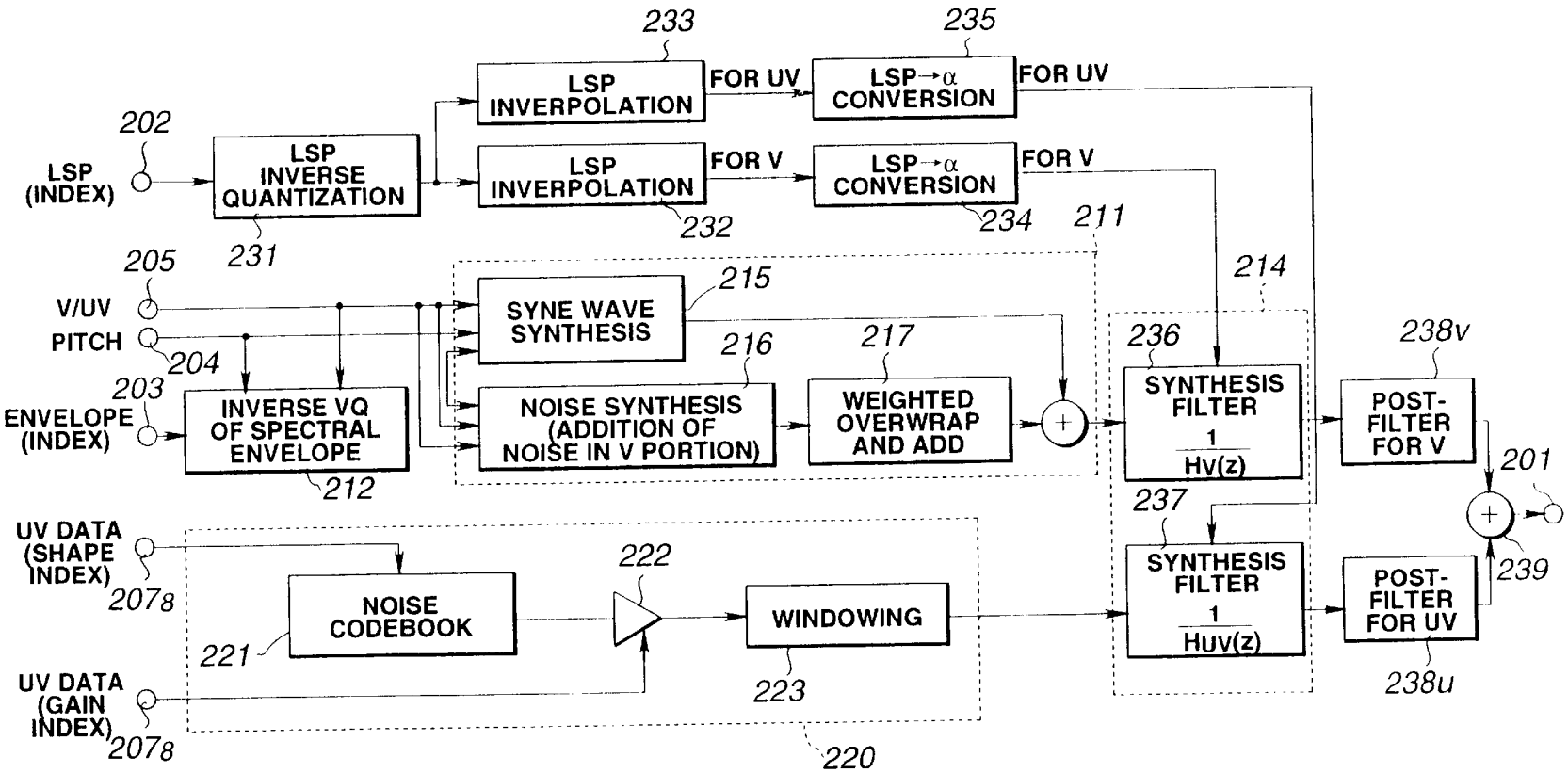
FIG. 4 is a block diagram showing in more detail the speech decoder shown in FIG. 2.

FIG. 2 is a block diagram showing a basic structure of a speech signal decoding apparatus, or decoder, which is a counterpart device of the encoding apparatus shown in FIG. 1, FIG. 3 is a block diagram showing in more detail the speech signal encoder shown in FIG. 1, and FIG. 4 is a block diagram showing in more detail the speech decoder shown in FIG. 2.

The circuits of the block diagrams of FIG. 1 to 4 are explained below.

The basic concept of the speech signal encoder of FIG. 1 is that the encoder has a first encoding unit 110 for finding short-term prediction residuals, such as linear prediction encoding (LPC) residuals, of the input speech signal for performing sinusoidal analysis encoding, such as harmonic coding, and a second encoding unit 120 for encoding the input speech signals by waveform coding exhibiting phase reproducibility, wherein the first and second encoding units 110, 120 are used for encoding the voiced portion and unvoiced portion of the input signal, respectively.

The first encoding unit 110 is constitute to encode the LPC residuals with sinusoidal analytic encoding such as harmonics encoding or multi-band encoding (MBE). The second encoding unit 120 constitutes a code excitation linear prediction (CELP) employing vector quantization by a closed loop search for finding an optimum vector and employing an analysis by synthesis method.

In this embodiment, the speech signal supplied to the input terminal 101 is fed to the inverse LPC filter 111 and to an LPC analysis/quantization unit 113 of the first encoding unit 110. The LPC coefficient obtained from the LPC analysis/quantization unit 113, or the so-called α-parameter, is sent to the inverse LPC filter 111 for taking out the linear prediction residuals (LPC residuals) of the input speech signals by the inverse LPC filter 111. From the LPC analysis/quantization unit 113, a quantization output of the linear spectral pairs (LSP) is output and fed to an output terminal 102. The LPC residuals from the inverse LPC filter 111 are sent to a sinusoidal analysis encoding unit 114. The sinusoidal analysis encoding unit 114 performs pitch detection, spectral envelope amplitude calculations and V/UV discrimination by a voiced (V)/unvoiced (UV) judgement unit 115. The spectral envelope amplitude data from the sinusoidal analysis encoding unit 114 are sent to the vector quantization unit 116. The codebook index from the vector quantization unit 116, as a vector quantization output of the spectral envelope, is fed via a switch 117 to an output terminal 103, while an output of the sinusoidal analysis encoding unit 114 is sent via a switch 118 to an output terminal 104. The V/UV discrimination output from the V/UV judgement unit 115 is sent to an output terminal 105 and is used to control the switches 117, 118. For the voiced (V) signal, the index and the pitch are output at the output terminals 103, 104, respectively.

In the present embodiment, the second encoding unit 120 of FIG. 1 has a code excitation linear prediction (CELP) encoding configuration and performs vector quantization of the time-domain waveform employing closed-loop search by the analysis-by-synthesis method, in which an output of a noise codebook 121 is synthesized by a weighted synthesis filter 122. The resulting weighted speech signal is fed to one input of a subtractor 123 where an error between the weighted speech signal and the speech signal supplied at the input terminal 101, after having been passed through a perceptually weighted filter 125, is produced and sent to a distance calculation circuit 124. The output of the distance calculation circuit 124 is fed to the noise codebook 121 to search for a vector that minimizes the error. This CELP encoding is used for encoding the unvoiced portion as described above. The codebook index forming the UV data from the noise codebook 121 is taken out at an output terminal 107 via a switch 127 which is turned on when the results of V/UV discrimination from the V/UV judgement unit 115 indicates an unvoiced (UV) sound.

FIG. 2 is a block diagram showing the basic structure of a speech signal decoder, as a counterpart device to the speech signal encoder of FIG. 1, for carrying out the speech decoding method according to the present invention.

Referring to FIG. 2, a codebook index as a quantization output of the linear spectral pairs (LSPs) from the output terminal 102 of FIG. 1 is supplied to an input terminal 202 of the decoder. Outputs at the terminals 103, 104, and 105 of FIG. 1, that is, the index data, pitch and the V/UV discrimination output as the envelope quantization outputs, are supplied to input terminals 203, 204, 205, respectively. The index data for the unvoiced data are supplied from the output terminal 107 of FIG. 1 to an input terminal 207 in FIG. 2.

The index forming the quantization input at terminal 203 is fed to an inverse vector quantization unit 212 for inverse vector quantization to find a spectral envelope of the LPC residues which is sent to a voiced speech synthesizer 211. The voiced speech synthesizer 211 synthesizes the linear prediction encoding (LPC) residuals of the voiced speech portion by sinusoidal synthesis. The voiced speech synthesizer 211 is also fed with the pitch and the V/UV discrimination inputs from terminals 204, 205, respectively. The LPC residuals of the voiced speech from the voiced speech synthesis unit 211 are sent to an LPC synthesis filter 214. The index data of the UV data from the input terminal 207 is sent to an unvoiced sound synthesis unit 220 where reference is had to the noise codebook for taking out the LPC residuals of the unvoiced portion. These LPC residuals are also sent to the LPC synthesis filter 214. In the LPC synthesis filter 214, the LPC residuals of the voiced portion and the LPC residuals of the unvoiced portion are processed by LPC synthesis. Alternatively, the LPC residuals of the voiced portion and the LPC residuals of the unvoiced portion could be summed together and processed with LPC synthesis. The LSP index data from the input terminal 202 is sent to an LPC parameter reproducing unit 213 where parameters of the LPC are taken out and fed to the LPC synthesis filter 214. The speech signals synthesized by the LPC synthesis filter 214 are fed out at an output terminal 201.

Referring to FIG. 3, the speech signal encoder of FIG. 1 is shown in more detail. In FIG. 3, the parts or components similar to those shown in FIG. 1 are denoted by the same reference numerals.

In the speech signal encoder shown in FIG. 3, the speech signals supplied to the input terminal 101 are filtered by a high-pass filter 109 for removing undesired low-frequency signals and thence supplied to an LPC analysis circuit 132 of the LPC analysis/quantization unit 113 and to the inverse LPC filter 111.

The LPC analysis circuit 132 of the LPC analysis/quantization unit 113 applies a Hamming window, with a length of the input signal waveform on the order of 256 samples as a block, and finds a linear prediction coefficient, which is the so-called parameter, by the self-correlation method. The framing interval as a data outputting unit is set to approximately 160 samples. If the sampling frequency fs is 8 kHz, for example, one-frame interval is 20 msec for 160 samples.

The parameter from the LPC analysis circuit 132 is sent to an LSP conversion circuit 133 for conversion into line spectra pair (LSP) parameters. This converts the parameter, as found by direct type filter coefficient, into ten, for example, that is, five pairs of the LSP parameters. This conversion is carried out by, for example, the Newton-Rhapson method. The reason the α-parameters are converted into the LSP parameters is that the LSP parameter is superior in interpolation characteristics to the α-parameters.

The LSP parameters from the α-LSP conversion circuit 133 are matrix quantized or vector quantized by the LSP quantizer 134, and it is possible to take a frame-to-frame difference prior to vector quantization, or to collect plural frames in order to perform matrix quantization. In the present case, two frames (20 msec) of the LSP parameters, calculated every 20 msec, are collected and processed with matrix quantization and vector quantization.

The quantized output from the quantizer 134, that is, the index data of the LSP quantization, are fed out at the output terminal 102, while the quantized LSP vector is fed to an LSP interpolation circuit 136.

The LSP interpolation circuit 136 interpolates the LSP vectors, quantized every 20 msec or 40 msec, in order to provide an eight-fold rate. That is, the LSP vector is updated every 2.5 msec. The reason for this is that, if the residual waveform is processed with the analysis/synthesis by the harmonic encoding/decoding method, the envelope of the synthetic waveform presents an extremely toothed waveform, so that if the LPC coefficients are changed abruptly every 20 msec an audible foreign noise is likely to be produced. On the other hand, if the LPC coefficient is changed gradually every 2.5 msec, such foreign noise may be prevented from occurring.

For inverse filtering of the input speech using the interpolated LSP vectors produced every 2.5 msec, the LSP parameters are converted by an LSP-to-α conversion circuit 137 into α-parameters as the coefficients for a ten-order direct type filter, for example. An output of the LSP-to-α conversion circuit 137 is sent to the LPC inverse filter circuit 111 which then performs inverse filtering for producing a smooth output using an α-parameter updated every 2.5 msec. The output of the inverse LPC filter 111 is fed to an orthogonal transform circuit 145, such as a DFT circuit, of the sinusoidal analysis encoding unit 114, which can be a harmonic encoding circuit.

The α-parameter from the LPC analysis circuit 132 of the LPC analysis/quantization unit 113 is also fed to a perceptual weighting filter calculating circuit 139 where data for perceptual weighting is found. These weighting data are sent to the perceptual weighting vector quantizer 116, to the perceptual weighting filter 125 of the second encoding unit 120, and to the perceptual weighted synthesis filter 122.

The sinusoidal analysis encoding unit 114 of the harmonic encoding circuit analyzes the output of the inverse LPC filter 111 by the method of harmonic encoding. That is, pitch detection, calculations of the amplitudes Am of the respective harmonics, and voiced (V)/ unvoiced (UW) discrimination are carried out and the numbers of the amplitudes Am or the envelopes of the respective harmonics that vary with the pitch are made constant by dimensional conversion.

In an illustrative example of the sinusoidal analysis encoding unit 114 shown in FIG. 3, commonplace harmonic encoding is used. More specifically, in multi-band excitation (MBE) encoding it is assumed in modelling that voiced portions and unvoiced portions are present in the frequency area or band at the same time point, that is, in the same block or frame. In other harmonic encoding techniques, it is uniquely judged whether the speech in one block or in one frame is voiced or unvoiced. In the following description, a given frame is judged to be UV if the totality of the band is UV, insofar as the MBE encoding is concerned.

The open-loop pitch search unit 141 and the zero-crossing counter 142 of the sinusoidal analysis encoding unit 114 of FIG. 3 are fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the output of the inverse LPC filter 111. The open loop pitch search unit 141 uses the LPC residuals of the input signals to perform relatively rough pitch search on the input signal at terminal 101 using an open loop. The extracted rough pitch data is sent to a fine or high-precision pitch search unit 146 using a closed loop, as explained below. From the open loop pitch search unit 141 the maximum value of the normalized self correlation r(p), obtained by normalizing the maximum value of the self-correlation of the LPC residuals along with the rough pitch data, are taken out along with the rough pitch data and fed to the V/UV discrimination unit 115.

The orthogonal transform circuit 145 performs an orthogonal transform, such as the discrete Fourier transform (DFT), for converting the LPC residuals on the time axis into spectral amplitude data on the frequency axis. An output of the orthogonal transform circuit 145 is sent to the high-precision pitch search unit 146 and a spectral evaluation unit 148 for evaluating the spectral amplitude or envelope.

The high-precision pitch search unit 146 is fed with relatively rough pitch data extracted by the open loop pitch search unit 141 and with frequency-domain data obtained by DFT by the orthogonal transform unit 145. The high-precision pitch search unit 146 swings the pitch data by plus or minus several samples, at a rate of 0.2 to 0.5, centered about the rough pitch value data, in order to arrive ultimately at the value of the fine pitch data having an optimum decimal point (floating point). The analysis-by-synthesis method is used as the fine search technique for selecting a pitch so that the power spectrum will be closest to the power spectrum of the original sound. Pitch data from the closed-loop high-precision pitch search unit 146 is fed to the output terminal 104 via the switch 118.

In the spectral evaluation unit 148, the amplitude of each of the harmonics and the spectral envelope forming the sum of the harmonics are evaluated based on the spectral amplitude and the pitch as the orthogonal transform output of the LPC residuals and are output to the high-precision pitch search unit 146, to the V/UV discrimination unit 115, and to the perceptually weighted vector quantization unit 116.

The V/UV judgement unit 115 discriminates V/UV for each frame based on an output of the orthogonal transform circuit 145, an optimum pitch from the high-precision pitch search unit 146, spectral amplitude data from the spectral evaluation unit 148, the maximum value of the normalized self-correlation r(p) from the open loop pitch search unit 141, and the zero-crossing count value from the zero-crossing counter 142. In addition, the boundary position of the band-based V/UV discrimination for the MBE may also be used as a condition for V/UV discrimination. A discrimination output of the V/UV discrimination unit 115 is fed out at the output terminal 105.

An output circuit of the spectrum evaluation unit 148 or an input circuit of the vector quantization unit 116 is provided with a data number conversion unit, not shown, which is a unit performing a sort of sampling rate conversion. Such a data number conversion unit is used for setting the amplitude data |Am| of an envelope, taking into account the fact that the number of bands that are split on the frequency axis and the number of data differ with the pitch. That is, if the effective band extends to 3400 kHz, the effective band can be split into from 8 to 63 separate bands depending on the pitch. The number mMX+1 of the amplitude data |Am| obtained from band to band is changed in the range from 8 to 63. Thus, the data number conversion unit, not shown, converts the amplitude data of the variable number mMx+1 to a pre-set number M of data, such as 44.

The amplitude data or envelope data of the pre-set number M, such as 44, from the data number conversion unit, provided at an output circuit of the spectral evaluation unit 148 or at an input circuit of the vector quantization unit 116, are collected in terms of units having a pre-set number of data, such as 44, by the vector quantization unit 116 that performs weighted vector quantization. This weighting is supplied by the output of the perceptually weighted filter calculation circuit 139. The index of the envelope from the vector quantizer 116 is fed out through the switch 117 at the output terminal 103. Prior to weighted vector quantization, it is advisable to determine the inter-frame difference using a suitable leakage coefficient for a vector made up of a pre-set number of data.

The second encoding unit 120 is now explained. The second encoding unit 120 has a so-called CELP encoding structure and is used in particular for encoding the unvoiced portion of the input speech signal. In the CELP encoding structure for the unvoiced portion of the input speech signal, a noise output, corresponding to the LPC residuals of the unvoiced sound as a representative value output of the noise codebook 121, which is a so-called stochastic codebook, is sent via a gain control circuit 126 to the perceptually weighted synthesis filter 122. The weighted synthesis filter 122 performs LPC synthesis on the input noise and sends the produced weighted unvoiced signal to one input of the subtractor 123. The subtractor 123 receives at another input the signal supplied from the input terminal 101 via the high-pass filter (HPF) 109 after having been perceptually weighted by the perceptually weighted synthesis filter 125. The difference or error between the signal and the input signal from the synthesis filter 122 is derived from the subtractor 123. Meanwhile, a zero input response from the perceptually weighted synthesis filter 122 has been previously subtracted from the output of the perceptual weighting filter output 125. The error signal from the subtractor 123 is fed to a distance calculation circuit 124 for calculating a distance between original speech and synthesized speech in the time domain waveforms that is fed back to the noise codebook 121 and a representative vector value which will minimize the error is searched for in the noise codebook 121. The above description is a summary of the vector quantization of the time-domain waveform employing the closed-loop search that in turn employs the analysis-by-synthesis method.

As data for the unvoiced (UV) portion from the second encoder 120 employing the CELP coding structure, the shape index of the codebook from the noise codebook 121 and the gain index of the codebook output from the gain circuit 126 are produced as outputs. The shape index, which is the UV data from the noise codebook 121, and the gain index, which is the UV data of the gain circuit 126, are sent via switch 127*s* to an output terminal 107*s* and via a switch 127*g* to an output terminal 107*g*, respectively.

These switches 127*s*, 127*g* and the switches 117, 118 are turned on and off depending on the results of the V/UV decision from the V/UV judgement unit 115. Specifically, the switches 117, 118 are turned on if the results of V/UV discrimination of the speech signal of the frame currently transmitted indicates a voiced (V) input, whereas the switches 127*s*, 127*g* are turned on if the speech signal of the frame currently transmitted is unvoiced (UV).

FIG. 4 shows the speech signal decoder of FIG. 2 in more detail. In FIG. 4, the same numerals are used to denote the same components shown in FIG. 2.

In FIG. 4, a vector quantization output of the LSP corresponding to the output terminal 102 of FIGS. 1 and 3, that is, the codebook index, is fed in at the input terminal 202.

The LSP index is sent to an inverse vector quantizer 231 of the LSP for the LPC parameter reproducing unit 213 so as to be inverse vector quantized to line spectral pair (LSP) data which are then supplied to LSP interpolation circuits 232, 233 for interpolation. The resulting interpolated data is converted by LSP-to-α conversion circuits 234, 235 to α-parameters which are fed to the LPC synthesis filter 214. The LSP interpolation circuit 232 and the LSP-to-α conversion circuit 234 are designed for voiced (V) sound, whereas the LSP interpolation circuit 233 and the LSP-to-α conversion circuit 235 are designed for unvoiced (UV) sound. The LPC synthesis filter 214 is separated into an LPC synthesis filter 236 for the voiced speech portion and an LPC synthesis filter 237 for the unvoiced speech portion. That is, LPC coefficient interpolation is carried out independently for the voiced speech portion and for the unvoiced speech portion, thereby prohibiting ill effects which might otherwise be produced in the transition portion from the voiced speech portion to the unvoiced speech portion, or vice versa, by interpolation of the LSPs of totally different properties.

Fed in at the input terminal 203 of FIG. 4 is the code index data corresponding to the weighted vector quantized spectra envelope Am which is the output at the terminal 103 of the encoder of FIGS. 1 and 3. Fed in at the input terminal 204 is the pitch data from the terminal 104 of FIGS. 1 and 3, and to the input terminal 205 is supplied the V/UV discrimination data from the output terminal 105 of FIGS. 1 and 3.

The vector-quantized index data of the spectral envelope Am from the input terminal 203 is fed to the inverse vector quantizer 212 for inverse vector quantization, wherein inverse conversion with respect to the data number conversion is carried out. The resulting spectral envelope data is sent to a sinusoidal synthesis circuit 215.

If the inter-frame difference is found prior to vector quantization of the spectrum during encoding, the inter-frame difference is decoded after performing inverse vector quantization in order to produce the spectral envelope data.

The sinusoidal synthesis circuit 215 receives the pitch information from the input terminal 204 and the V/UV discrimination data from the input terminal 205. The sinusoidal synthesis circuit 215 produces LPC residual data corresponding to the output of the LPC inverse filter 111 shown in FIGS. 1 and 3 that is fed to one input to an adder 218.

The envelope data from the inverse vector quantizer 212 and the pitch and the V/UV discrimination data from the input terminals 204, 205, respectively, are sent to a noise synthesis circuit 216 for noise addition for the voiced portion (V). An output of the noise synthesis circuit 216 is sent to a second input of the adder 218 via a weighted overlap-add circuit 217. Specifically, the noise takes into account the fact that if the excitation as an input to the LPC synthesis filter of the voiced sound is produced by sinusoidal synthesis, a stuffed feeling is produced to the listener for low-pitched sounds such as male speech. Moreover, when the sound quality is abruptly changed between the voiced sound and the unvoiced sound thus producing an unnatural hearing feeling, this unnatural feeling is avoided by adding the noise to the voiced portion of the LPC residual signals. Such noise takes into account the parameters concerned with speech encoding data, such as pitch, amplitudes of the spectral envelope, maximum amplitude in a frame, and the residual signal level in connection with the LPC synthesis filter input of the voiced speech portion, that is, excitation. Examples of such sinusoidal synthesis are found in Japanese Published Patent Application: JP Kokai 05-265487 as well as in U.S. patent application Ser. No. 08/150,082.

A summed output of the adder 218 is sent to a synthesis filter 236 for the voiced sound forming a part of the LPC synthesis filter 214, wherein LPC synthesis is carried out to form time waveform data, which then is filtered by a post-filter 238*v* for the voiced speech and fed to one input of an adder 239.

The shape index and the gain index, as UV data from the output terminals 107*s* and 107*g* of FIG. 3, are supplied to the input terminals 207*s* and 207*g* of FIG. 4, respectively, and thence supplied to the unvoiced speech synthesis unit 220. The shape index from the input terminal 207*s* is fed to the noise codebook 221 of the unvoiced speech synthesis unit 220, while the gain index from the input terminal 207*g* is sent to the gain circuit 222. The representative value output read out from the noise codebook 221 is a noise signal component corresponding to the LPC residuals of the unvoiced speech. This results in a pre-set amplitude signal fed through a gain circuit 222 to a windowing circuit 223, so as to be windowed for smoothing the junction with the voiced speech portion.

The output of the windowing circuit 223 is fed to a synthesis filter 237 for the unvoiced (UV) speech of the LPC synthesis filter 214. The data sent to the synthesis filter 237 is processed with LPC synthesis to become time waveform data for the unvoiced portion. This time waveform data of the unvoiced portion is filtered by a post-filter 238*u* for the unvoiced portion before being sent to a second input of the adder 239.

In the adder 239, the time waveform signal from the post-filter 238*v* for the voiced speech and the time waveform data for the unvoiced speech portion from the post-filter 238*u* for the unvoiced speech are added to each other and the resulting sum data is taken out at the output terminal 201.

The above-described speech signal encoder can output data of different bit rates depending on the demanded sound quality. That is, the output data can be outputted with variable bit rates. For example, if the low bit rate is 2 kbps and the high bit rate is 6 kbps, the output data can have the following bit rates shown in Table 1.

TABLE 1

| | 2 kbps | 6 kbps |
|---|---|---|
| U/V decision output | 1 bit/20 msec | 1 bit/20 msec |
| LSP quantization index for voiced speech (V) | 32 bits/40 msec<br>index 15 bits/20 msec<br>pitch data 8 bits/20 msec<br>shape (for first stage), 5 + 5 bits/20 msec<br>gain, 5 bits/20 msec | 48 bits/40 msec<br>index 87 bits/20 msec<br>pitch data 8 bits/20 msec<br>shape (for first stage), 5 + 5 bits/20 msec<br>gain, 5 bits/20 msec<br>gain (for second stage), 72 bits/20 msec |

TABLE 1-continued

| | 2 kbps | 6 kbps |
|---|---|---|
| for unvoiced speech (UV) | index 11 bits/10 msec<br>shape (for first stage), 7 bits /10 msec<br>gain, 4 bits/10 msec | index 23 bits/5 msec<br>shape for first stage, 9 bits/5 msec<br>gain, 6 bits/5 msec<br>shape for second stage, 5 bits/5 msec<br>gain, 3 bits/5 msec |
| for voiced speech | 40 bits/20 msec | 120 bits/20 msec |
| for unvoiced speech | 39 bits/20 msec | 117 bits/20 msec |

msec for the voiced speech, with the V/UV discrimination output from the output terminal 105 being at all times 1 bit/20 msec. The index for LSP quantization, outputted from the output terminal 102, is switched between 32 bits/40 msec and 48 bits/40 msec. On the other hand, the index during the voiced speech (V) output at the output terminal 103 is switched between 15 bits/20 msec and 87 bits/20 msec. The index for the unvoiced (UV) output at the output terminals 107*s* and 107*g* is switched between 11 bits/10 msec and 23 bits/5 msec. The output data for the voiced sound (UV) is 40 bits/20 msec for 2 kbps and 120 kbps/20 msec for 6 kbps. On the other hand, the output data for the voiced sound (UV) is 39 bits/20 msec for 2 kbps and 117 kbps/20 msec for 6 kbps.

The index for LSP quantization, the index for voiced speech (V), and the index for the unvoiced speech (UV) are explained hereinbelow in connection with the arrangement of pertinent portions.

Figure 5:
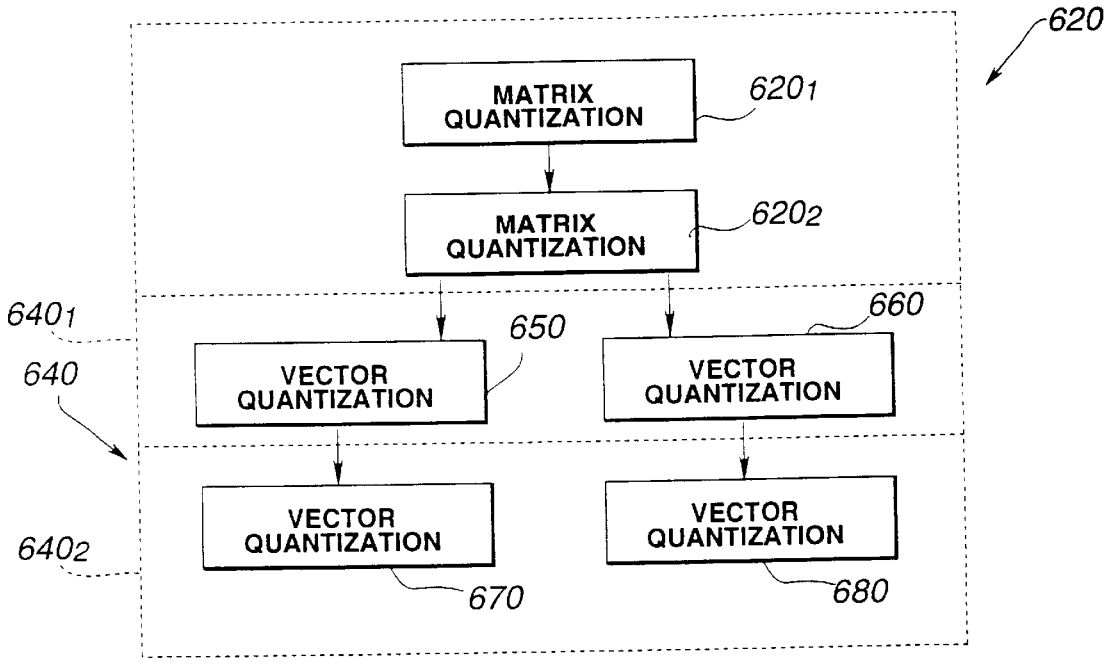
FIG. 5 is a block diagram showing a basic structure of an LPC quantizer.
Figure 6:
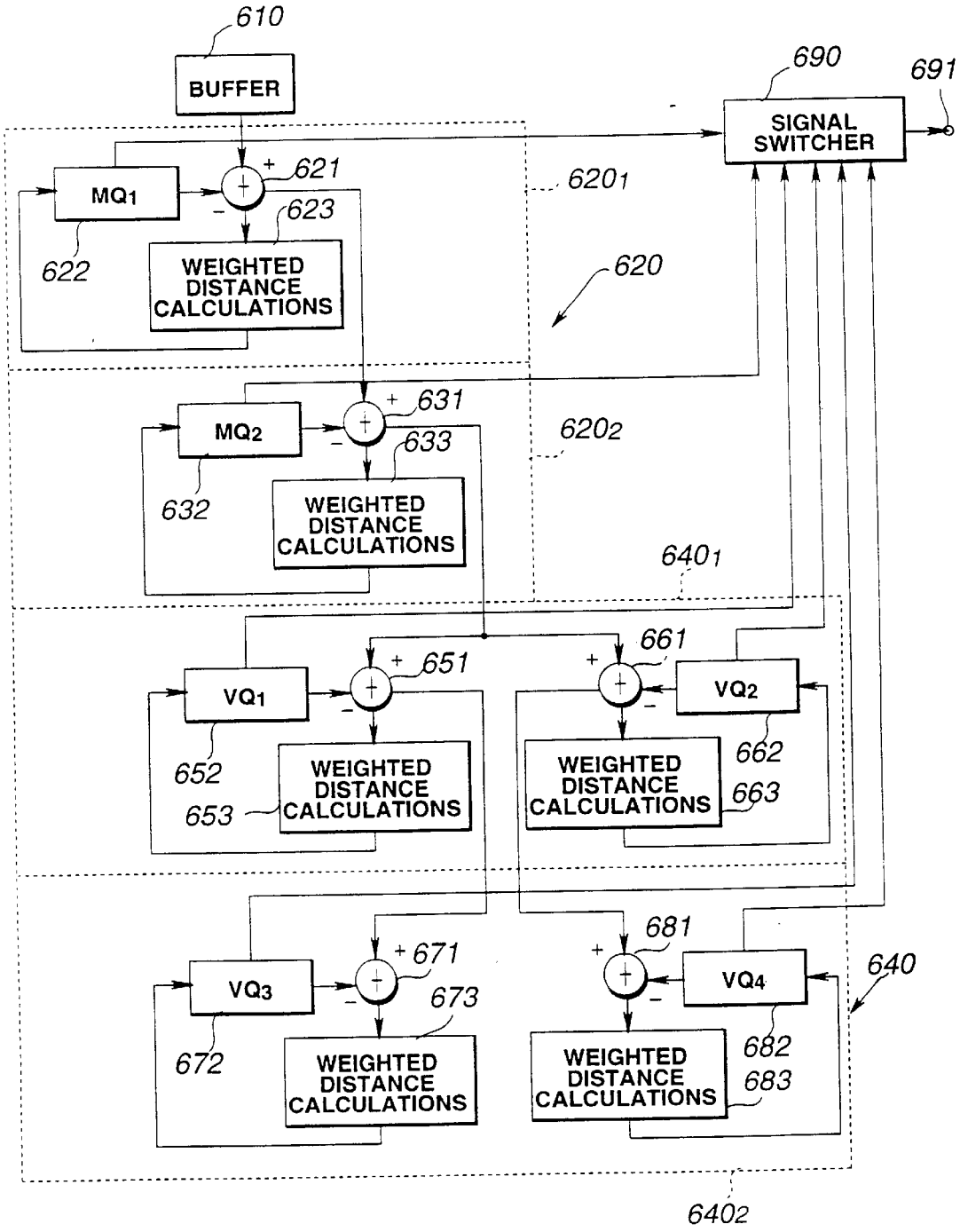
FIG. 6 is a block diagram showing a more detailed structure of the LPC quantizer of FIG. 5.

Referring to FIG. 5 and 6, matrix quantization and vector quantization in the LSP quantizer 134 of FIG. 3 are explained in detail.

In FIG. 3, the α-parameters from the LPC analysis circuit 132 are sent to the α-LSP circuit 133 for conversion to LSP parameters. If the P-order LPC analysis is performed in a LPC analysis circuit 132, P α-parameters are calculated. These P α-parameters are converted into LSP parameters which are held in a buffer 610, shown in FIG. 6.

The buffer 610 outputs 2 frames of LSP parameters. The two frames of the LSP parameters are matrix-quantized by a matrix quantizer 620, shown in FIG. 5, made up of a first matrix quantizer $\mathbf{620}_1$ and a second matrix quantizer $\mathbf{620}_2$. The two frames of the LSP parameters are matrix-quantized in the first matrix quantizer $\mathbf{620}_1$ and the resulting quantization error is further matrix-quantized in the second matrix quantizer $\mathbf{620}_2$. This matrix quantization exploits correlation in both the time axis and in the frequency axis.

The quantization errors for two frames from the matrix quantizer $\mathbf{620}_2$ are fed to a vector quantization unit 640 made up of a first vector quantizer $\mathbf{640}_1$ and a second vector quantizer $\mathbf{640}_2$. The first vector quantizer $\mathbf{640}_1$ is made up of two vector quantization portions 650, 660, and the second vector quantizer $\mathbf{640}_2$ is also made up of two vector quantization portions 670, 680. The quantization error from the matrix quantization unit 620 is quantized on the frame or time axis basis by the vector quantization portions 650, 660 of the first vector quantizer $\mathbf{640}_1$. The resulting quantization error vector is further vector-quantized by the vector quantization portions 670, 680 of the second vector quantizer $\mathbf{640}_2$. The above described vector quantization of quantizers 670, 680 exploits correlation along the frequency axis.

The matrix quantization unit 620, executing the matrix quantization as described above, includes at least a first matrix quantizer $\mathbf{620}_1$ for performing first matrix quantization step and a second matrix quantizer $\mathbf{620}_2$ for performing second matrix quantization step for matrix quantizing the quantization error produced by the first matrix quantization. The vector quantization unit 640, executing the vector quantization as described above, includes at least a first vector quantizer $\mathbf{640}_1$ for performing a first vector quantization step and a second vector quantizer $\mathbf{640}_2$ for performing a second vector quantization step for matrix quantizing the quantization error produced by the first vector quantization.

The matrix quantization and the vector quantization of the system of FIGS. 5 and 6 will now be explained in detail.

The LSP parameters for two frames, stored in the buffer 610 as a 10 by 2 matrix, are sent to the first matrix quantizer $\mathbf{620}_1$. The first matrix quantizer $\mathbf{620}_1$ sends LSP parameters for two frames via LSP parameter adder 621 to a weighted distance calculating unit 623 for finding the weighted distance of the minimum value.

The distortion measure $d_{MQ1}$ during codebook search by the first matrix quantizer $\mathbf{620}_1$ is given by the equation (1):

$$d_{MQ1}(X_1, X_1-) = \sum_{t=0}^{1} \sum_{i=1}^{p} W(t, i)\,(X_1(t, i) - X_1 - (t, i))^2$$

where $X_1$ is the LSP parameter and $X_1'$ is the quantization value, with t and i being the numbers of the P-dimension.

The weight W, in which weight limitation in the frequency axis and in the time axis is not taken into account, is given by the equation (2):

$$W(t, i) = \frac{1}{X(t, i+1) - X(t, i)} + \frac{1}{X(t, i) - X(t, i-1)} \tag{2}$$

where $X_{i-1}=0$ if i=1 and $X_{i+1}=\pi$ if i=p.

The weight of the equation (2) is also used for downstream side matrix quantization and vector quantization.

The calculated weighted distance is sent to a matrix quantizer $MQ_1$ 622 for matrix quantization. An 8-bit index output by this matrix quantization is sent to a signal switcher 690. The quantization value obtained by matrix quantization is subtracted in the adder 621 from the LSP parameters for two frames. The weighted distance calculating unit 623 sequentially calculates the weighted distance every two frames so that matrix quantization is carried out in the matrix quantization unit 622. Also, a quantization value minimizing the weighted distance is selected. The output of the adder 621 is fed to the plus input of an adder 631 of the second matrix quantizer $\mathbf{620}_2$.

Similar to the first matrix quantizer $\mathbf{620}_1$, the second matrix quantizer $\mathbf{620}_2$ performs matrix quantization. The output of the adder 621 is fed via the adder 631 to a weighted distance calculation unit 633 where the minimum weighted distance is calculated.

The distortion measure $d_{MQ2}$ during the codebook search by the second matrix quantizer $\mathbf{620}_2$ is given by the equation (3):

$$d_{MQ2}(X_2, X_2-) = \sum_{t=0}^{1} \sum_{i=1}^{p} W(t, i)\,(X_1(t, i) - X_2 - (t, i))^2 \tag{3}$$

where $X_2$ and $X_2'$ are the quantization error and the quantization value from the first matrix quantizer $\mathbf{620}_1$, respectively.

The weighted distance is sent to a matrix quantization unit ($MQ_2$) 632 for matrix quantization. An 8-bit index, derived by matrix quantization is subtracted by the adder 631 from the two-frame quantization error. The weighted distance calculation unit 633 sequentially calculates the weighted distance using the output of the adder 631. The quantization value minimizing the weighted distance is selected. An output of the adder 631 is sent to the adders 651, 661 of the first vector quantizer 6401 on a frame by frame basis.

The first vector quantizer $\mathbf{640}_1$ performs vector quantization on a frame-by-frame basis, and the output of the adder 631 is sent frame by frame to each of the weighted distance calculating units 653, 663 via adders 651, 661 for calculating the minimum weighted distance.

The difference between the quantization error $X_2$ and the quantization error $X_2'$ is a matrix of (10 by 2). If the difference is represented as $X_2-X_2'=[\underline{X}_{3-1}, \underline{X}_{3-2}]$, the distortion measures $d_{VQ1}$, $d_{VQ2}$ during codebook search by the vector quantization units 652, 662 of the first vector quantizer $\mathbf{640}_1$ are given by the equations (4) and (5):

$$d_{VQ1}(\underline{X}_{3-1}, \underline{X}_{3-1}-) = \sum_{i=1}^{p} W(0, i)\,(X_{3-1}(0, i) - X_{3-1} - (0, i))^2 \tag{4}$$

$$d_{VQ2}(\underline{X}_{3-2}, \underline{X}_{3-2}-) = \sum_{i=1}^{p} W(1, i)\,(X_{3-2}(1, i) - X_{3-2} - (1, i))^2 \tag{5}$$

The weighted distance is sent to a vector quantization unit $VQ_1$ 652 and a vector quantization unit$_2$ VQ 662 for vector quantization. Each 8-bit index output by this vector quantization operation is sent to the signal switcher 690. The quantization value is subtracted by the adders 651, 661 from the input two-frame quantization error vector. The weighted distance calculating units 653, 663 sequentially calculate the weighted distance, using the outputs of the adders 651, 661, for selectingthe quantization value minimizing the weighted distance. The outputs of the adders 651, 661 are sent to adders 671, 681 of the second vector quantizer $\mathbf{640}_2$.

The distortion measure $d_{VQ3}$, $d_{VQ4}$ during codebook searching by the vector quantizers 672, 682 of the second vector quantizer $\mathbf{640}_2$, for $$\underline{X}_{4-1}=X_{3-1}-\underline{X}_{3-1}'$$

$$\underline{X}_{4-2}=X_{3-2}-\underline{X}_{3-2}'$$

are given by the equations (6) and (7):

$$d_{VQ3}(\underline{X}_{4-1}, \underline{X}_{4-1}-) = \sum_{i=1}^{p} W(0, i)\,(X_{4-1}(0, i) - X_{4-1} - (0, i))^2 \tag{6}$$

$$d_{VQ4}(\underline{X}_{4-2}, \underline{X}_{4-2}-) = \sum_{i=1}^{p} W(1, i)\,(X_{4-2}(1, i) - X - {}_{4-2}\,(1, i))^2 \tag{7}$$

These weighted distances are sent to the vector quantizer ($VQ_3$) 672 and to the vector quantizer ($VQ_4$) 682 for vector quantization. The 8-bit output index data from the vector quantization operations are subtracted by the adders 671, 681 from the input quantization error vector for two frames. The weighted distance calculating units 673, 683 sequentially calculate the weighted distances using the outputs of the adders 671, 681 for selecting the quantization value minimizing the weighted distances.

During codebook learning, learning is performed by the general Lloyd algorithm based on the respective distortion measures.

The distortion measures during codebook searching and during learning may be the same or different values.

The 8-bit index data from the matrix quantization units 622, 632 and the vector quantization units 652, 662, 672 and 682 are switched by the signal switcher 690 and fed out at an output terminal 691.

Specifically, for a low-bit rate outputs of the first matrix quantizer $\mathbf{620}_1$ carrying out the first matrix quantization step, second matrix quantizer $\mathbf{620}_2$ carrying out the second matrix quantization step and the first vector quantizer $\mathbf{640}_1$ carrying out the first vector quantization step are taken out, whereas for a high bit rate the output for the low bit rate is summed to an output of the second vector quantizer 640$_2$ carrying out the second vector quantization step and the resulting sum is taken out.

This output is an index of 32 bits/40 msec and an index of 48 bits/40 msec for 2 kbps and 6 kbps, respectively.

The matrix quantization unit 620 and the vector quantization unit 640 perform weighting limited in the frequency axis and/or the time axis in conformity to characteristics of the parameters representing the LPC coefficients.

The weighting limited in the frequency axis in conformity to characteristics of the LSP parameters will be explained first.

If the order number is P=10, the LSP parameters are grouped into $$L_1=\{X(i)|1\leqq i\leqq 2\}$$

$$L_2=\{X(i)|3\leqq i\leqq 6\}$$

$$L_3=\{X(i)|7\leqq i\leqq 10\}$$

for three ranges of low, mid, and high ranges, respectively. If the weighting of the groups $L_1$, $L_2$ and $L_3$ is ¼, ½, and ¼, the weighting limited only in the frequency axis is given by the equations (8), (9) and (10)

$$W-(i)=\frac{W(i)}{\sum_{j=1}^{2} W(j)}\times\frac{1}{4} \tag{8}$$

$$W-(i)=\frac{W(i)}{\sum_{j=3}^{6} W(j)}\times\frac{1}{2} \tag{9}$$

$$W-(i)=\frac{W(i)}{\sum_{j=7}^{10} W(j)}\times\frac{1}{4} \tag{10}$$

The weighting of the respective LSP parameters is performed in each group only and such weight is limited by the weighting for each group.

Looking in the time axis direction, the sum total of the respective frames is necessarily 1, so that limitation in the time axis direction is frame-based. The weight limited only in the time axis direction is given by the following equation (11):

$$W-(i,t)=\frac{W(i,t)}{\sum_{j=1}^{10}\sum_{s=0}^{T} W(j,s)} \tag{11}$$

where $1\leqq i\leqq 10$ and $0\leqq t\leqq 1$.

By this equation (11), weighting not limited in the frequency axis direction is carried out between two frames with the frame numbers of t=0 and t=1. This weighting limited only in the time axis direction is carried out between two frames processed with matrix quantization.

During learning, the totality of frames used as learning data, having the total number T, is weighted in accordance with the equation (12):

$$W-(i,t)=\frac{W(i,t)}{\sum_{j=1}^{10}\sum_{s=0}^{T} W(j,s)} \tag{12}$$

where $1\leqq i\leqq 10$ and $0\leqq t\leqq T$

The weighting limited in the frequency axis direction and in the time axis direction is now explained.

If the order number is P=10, the LSP parameters are grouped into $$L_1=\{X(i,t)|1\leqq i\leqq 2,\ 0\leqq t\leqq 1\}$$

$$L_2=\{X(i,t)|3\leqq i\leqq 6,\ 0\leqq t\leqq 1\}$$

$$L_3=\{X(i,t)|7\leqq i\leqq 10,\ 0\leqq t\leqq 1\}$$

for three ranges of low, mid, and high ranges, respectively. If the weighting of the groups $L_1$, $L_2$ and $L_3$ is ¼, ½, and ¼, the weighting limited only in the frequency axis is given by the equations (13), (14) and (15):

$$W-(i,t)=\frac{W(i,t)}{\sum_{j=1}^{2}\sum_{s=0}^{1} W(j,s)}\times\frac{1}{4} \tag{13}$$

$$W-(i,t)=\frac{W(i,t)}{\sum_{j=3}^{6}\sum_{s=0}^{1} W(j,s)}\times\frac{1}{2} \tag{14}$$

$$W-(i,t)=\frac{W(i,t)}{\sum_{j=7}^{10}\sum_{s=0}^{1} W(j,s)}\times\frac{1}{4} \tag{15}$$

By these equations (13), (14), and (15), weighting limited every three frames in the frequency axis direction and across two frames processed with matrix quantization is carried out. This is effective during codebook search and during learning.

During learning, weighting is for the totality of frames of the entire data. The LSP parameters X(i, t) are grouped into $$L_1=\{X(i,t)|1\leqq i\leqq 2,\ 0\leqq t\leqq T\}$$

$$L_2=\{X(i,t)|3\leqq i\leqq 6,\ 0\leqq t\leqq T\}$$

$$L_3=\{X(i,t)|7\leqq i\leqq 10,\ 0\leqq t\leqq T\}$$

for low, mid, and high ranges, respectively. If the weighting of the groups $L_1$, $L_2$ and $L_3$ is ¼, ½, and ¼, the weighting for the groups $L_1$, $L_2$ and $L_3$, limited only in the frequency axis, is given by the equations (16), (17) and (18):

$$W-(i,t)=\frac{W(i,t)}{\sum_{j=1}^{2}\sum_{s=0}^{T} W(j,s)}\times\frac{1}{4} \tag{16}$$

$$W-(i,t)=\frac{W(i,t)}{\sum_{j=3}^{6}\sum_{s=0}^{T} W(j,s)}\times\frac{1}{2} \tag{17}$$

$$W-(i,t)=\frac{W(i,t)}{\sum_{j=7}^{10}\sum_{s=0}^{T} W(j,s)}\times\frac{1}{4} \tag{18}$$

By these equations (16) (17), and (18), weighting can be performed for three ranges in the frequency axis direction and across the totality of frames in the time axis direction.

In addition, the matrix quantization unit 620 and the vector quantization unit 640 perform weighting depending on the magnitude of changes in the LSP parameters. In V to UV or UV to V transition regions, which represent minority frames among the totality of speech frames, the LSP parameters are changed significantly due to difference in the frequency response between consonants and vowels. Therefore, the weighting shown by the equation (19) may be multiplied by the weighting W' (i, t) for weighting placing emphasis on the transition regions.

$$Wd(t) = \sum_{i=1}^{10} |X_1(i, t) - X_1(i, t-1)|^2 \quad (19)$$

The following equation (20):

$$Wd(t) = \sum_{i=1}^{10} \sqrt{|X_1(i, t) - X_1(i, t-1)|} \quad (20)$$

may be used in place of the equation (19).

Thus the LSP quantization unit 134 executes two-stage matrix quantization and two-stage vector quantization to render the number of bits of the output index variable.

Figure 7:
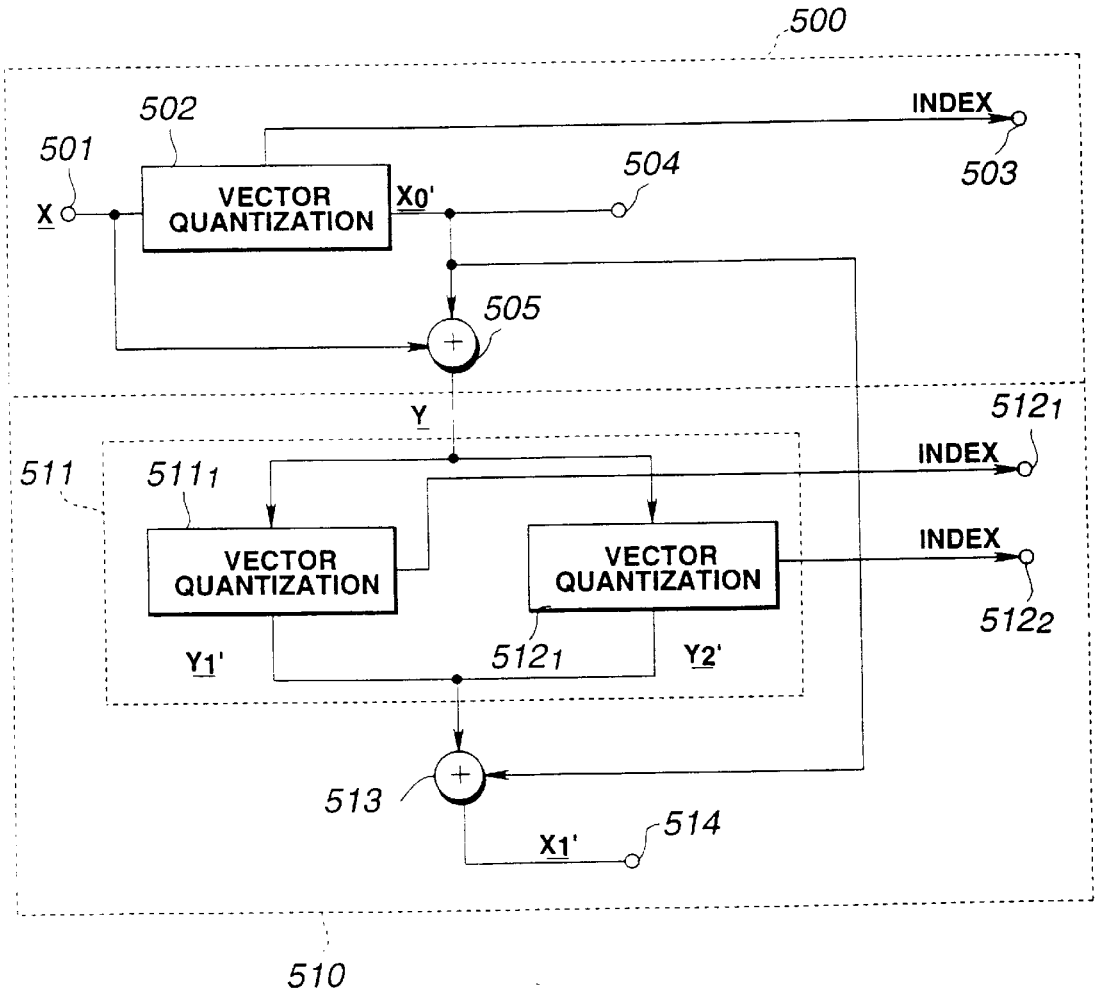
FIG. 7 is a block diagram showing a basic structure of a vector quantizer.
Figure 8:
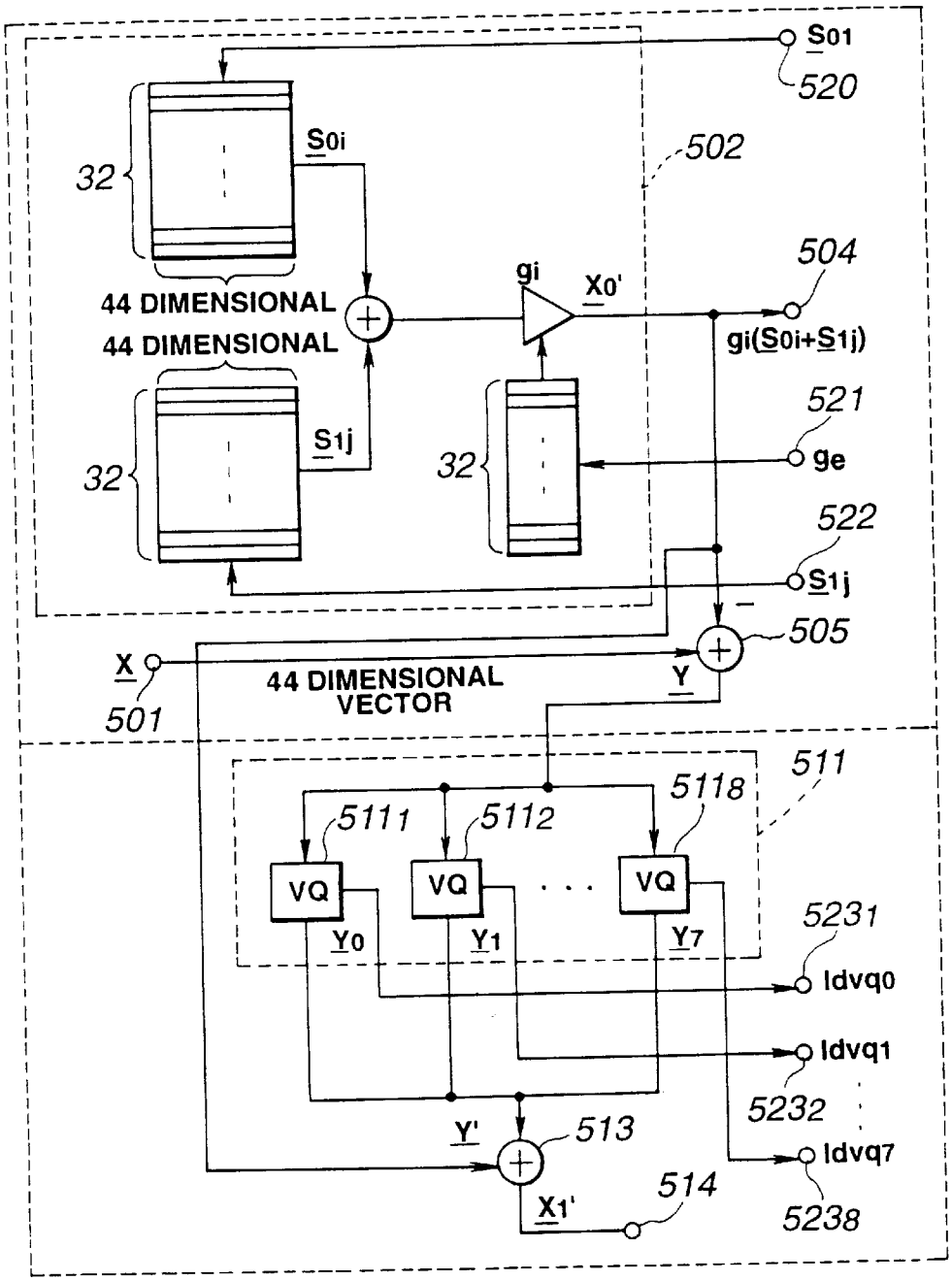
FIG. 8 is a block diagram showing a more detailed structure of the vector quantizer of FIG. 7.

The basic structure of the vector quantization unit 116 is shown in FIG. 7, while a more detailed structure of the vector quantization unit 116 shown in FIG. 7 is shown in FIG. 8. An illustrative structure of weighted vector quantization for the spectral envelope Am in the vector quantization unit 116 is explained below.

First, in the speech signal encoding device shown in FIG. 3, an illustrative arrangement for data number conversion for providing a constant number of data of the amplitude of the spectral envelope on an output side of the spectral evaluating unit 148 or on an input side of the vector quantization unit 116 will be explained.

A variety of methods may be conceived for such data number conversion. In the present embodiment, dummy data interpolating the values from the last data in a block to the first data in the block or other pre-set data such as data repeating the last data or the first data in a block are appended to the amplitude data of one block of an effective band on the frequency axis for enhancing the number of data to $N_F$, amplitude data equal in number to Os times, such as eight times, are found by Os-fold oversampling, such as eight-fold oversampling of the limited bandwidth type by, for example, an FIR filter. The ((mMx+1)×Os amplitude data are linearly interpolated for expansion to a larger $N_M$ number, such as 2048. This $N_M$ data is sub-sampled for conversion to the above-mentioned preset number M of data, such as 44 data.

In effect, only data necessary for formulating M data ultimately required is calculated by oversampling and linear interpolation without finding the above-mentioned $N_M$ data.

The vector quantization unit 116 for carrying out the weighted vector quantization of FIG. 7 at least includes a first vector quantization unit 500 for performing the first vector quantization step and a second vector quantization unit 510 for carrying out the second vector quantization step for quantizing the quantization error vector produced during the first vector quantization by the first vector quantization unit 500. This first vector quantization unit 500 is a so-called first-stage vector quantization unit, while the second vector quantization unit 510 is a so-called second-stage vector quantization unit.

An output vector $\underline{X}$ of the spectral evaluation unit 148, that is envelope data having a pre-set number M, enters an input terminal 501 of the first vector quantization unit 500. This output vector $\underline{X}$ is quantized with weighted vector quantization by the vector quantization unit 502. Thus a shape index outputted by the vector quantization unit 502 is outputted at an output terminal 503, while a quantized value $\underline{X}_0'$ is outputted at an output terminal 504 and sent to adders 505, 513. The adder 505 subtracts the quantized value $\underline{X}_0'$ from the source vector $\underline{X}$ to give a multi-order quantization error vector $\underline{Y}$.

The quantization error vector $\underline{Y}$ is sent to a vector quantization unit 511 in the second vector quantization unit 510. This second vector quantization unit 511 is made up of plural vector quantization units, or two vector quantizers $\mathbf{511}_1$, $\mathbf{511}_2$ in FIG. 7. The quantization error vector $\underline{Y}$ is dimensionally split so as to be quantized by weighted vector quantization in the two vector quantizers $\mathbf{511}_1$, $\mathbf{511}_2$. The shape index outputted by these vector quantizers $\mathbf{511}_1$, $\mathbf{512}_2$ is outputted at output terminals $\mathbf{512}_1$, $\mathbf{512}_2$, while the quantized values $\underline{Y}_1'$, $\underline{Y}_2'$ are connected in the dimensional direction and sent to an adder 513. The adder 513 adds the quantized values $\underline{Y}_1'$, $\underline{Y}_2'$ to the quantized value $\underline{X}_0'$ to generate a quantized value $\underline{X}_1'$ which is fed out at an output terminal 514.

Thus, for the low bit rate an output of the first vector quantization step by the first vector quantization unit 500 is taken out, whereas for the high bit rate an output of the first vector quantization step and an output of the second quantization step by the second quantization unit 510 are output.

Specifically, the vector quantizer 502 in the first vector quantization unit 500 in the vector quantization section 116 is of an L-order, such as a 44-order two-stage structure, as shown in FIG. 8.

That is, the sum of the output vectors of the 44-order vector quantization codebook with the codebook size of 32, multiplied with a gain $g_i$, is used as a quantized value $\underline{X}_0'$ of the 44-order spectral envelope vector $\underline{X}$.

Thus, as shown in FIG. 8, the two codebooks are CB0 and CB1, while the output vectors are $\underline{s}_{1i}$, $\underline{s}_{1j}$, where $0 \leqq i$ and $j \leqq 31$. On the other hand, an output of the gain codebook $CB_g$ is $g_L$, where $0 \leqq 1 \leqq 31$, where $g_L$ is a scalar. An ultimate output $\underline{X}_0'$ is $g_L$ $(\underline{s}_{1i}+\underline{s}_{1j})$.

The spectral envelope Am obtained by the above MBE analysis of the LPC residuals and converted into a pre-set order is $\underline{X}$. It is crucial how efficiently $\underline{X}$ is to be quantized.

The quantization error energy E is defined by $$\begin{aligned} E &= \|W\{H\underline{X} - Hgl((\underline{s}_{0i} + \underline{s}_{1j})\}\|^2 \\ &= \|WH\{\underline{X} - \{\underline{X} - g_L(\underline{s}_{0i} + \underline{s}_{1j})\}\|^2 \end{aligned} \quad (21)$$

where H denotes characteristics on the frequency axis of the LPC synthesis filter and W a matrix for weighting for representing characteristics for perceptual weighting on the frequency axis.

If the α-parameter by the results of LPC analyses of the current frame is denoted as $\alpha_i$ $(1 \leqq i \leqq P)$, the values of the L-order, for example, 44-order corresponding points, are sampled from the frequency response of the equation (22):

$$H(z) = \frac{1}{1 + \sum_{i=1}^{P} \alpha_i z^{-i}} \quad (22)$$

For calculations, 0's are stuffed next to a string of 1, $\alpha_1$, $\alpha_2$, . . . $\alpha_P$ to give a string of 1, $\alpha_1$, $\alpha_2$, . . . , $\alpha_P$, 0, 0, . . . , 0 to give 256-point data. Then, by 256-point FFT, $(r_e^2+Im^2)^{1/2}$ are calculated for point associated with a range from 0 to π and the reciprocals of the results are found. These reciprocals are sub-sampled to L points, such as 44 points, and a matrix is formed having these L points as diagonal elements:

$$H = \begin{bmatrix} h(1) & & & 0 \\ & h(2) & & \\ & & \ddots & \\ 0 & & & h(L) \end{bmatrix}$$

A perceptually weighted matrix W is given by the equation (23):

$$W(z) = \frac{1 + \sum_{i=1}^{P} \alpha_i \lambda_b^i z^{-i}}{1 + \sum_{i=1}^{P} \alpha_i \lambda_a^i z^{-i}} \tag{23}$$

where $\alpha_i$ is the result of the LPC analysis, and λa, λb are constants, such that λa=0.4 and λb=0.9.

The matrix W may be calculated from the frequency response of the above equation (23). For example, FFT is done on 256-point data of 1, α1λb, α2λ1b$^2$, . . . αpλb$^P$, 0, 0, . . . , 0 to find $(r_e^2[i]+Im^2[i])^{1/2}$ for a domain from 0 to π, where 0≦i≦128. The frequency response of the denominator is found by 256-point FFT for a domain from 0 to π for 1, α1λa, α2λa$^2$, . . . , αpλa$^P$, 0, 0, . . . , 0 at 128 points to find $(re'^2[i]+Im'^2[i])^{1/2}$, where 0≦i≦128. The frequency response of the equation 23 may be found by $$w_0[i] = \frac{\sqrt{re^2[i] + Im^2[i]}}{\sqrt{re - {}^2[i] + Im - {}^2[i]}}$$

where 0≦i≦128. This is found for each associated point of, for example, the 44-order vector, by the following method. More precisely, linear interpolation should be used, however, in the following example, the closest point is used instead.

That is, $$\omega[i]=\omega 0\ [nint\{128i/L)],$$

where 1≦i≦L.

In the equation nint(X) is a function which returns a value closest to X.

As for H, h(1), h(2), . . . h(L) are found by a similar method. That is, $$H = \begin{bmatrix} h(1) & & & 0 \\ & h(2) & & \\ & & \ddots & \\ 0 & & & h(L) \end{bmatrix} \quad W = \begin{bmatrix} w(1) & & & 0 \\ & w(2) & & \\ & & \ddots & \\ 0 & & & w(L) \end{bmatrix} \tag{24}$$

$$WH = \begin{bmatrix} h(1)w(1) & & & 0 \\ & h(2)w(2) & & \\ & & \ddots & \\ 0 & & & h(L)w(L) \end{bmatrix}$$

As another example, H(z)W(z) is first found and the frequency response is then found for decreasing the number of times of FFT. That is, the denominator of the equation (25):

$$H(z)W(z) = \frac{1}{1 + \sum_{i=1}^{P} \alpha_i z^{-i}} \cdot \frac{1 + \sum_{i=1}^{P} \alpha_i \lambda_b^i z^{-i}}{1 + \sum_{i=1}^{P} \alpha_i \lambda_a^i z^{-i}} \tag{25}$$

is expanded to $$\left(1 + \sum_{i=1}^{P} \alpha_i z^{-i}\right)\left(1 + \sum_{i=1}^{P} \alpha_a^i \lambda_a^i z^{-i}\right) = 1 + \sum_{i=1}^{2P} \beta_i z^{-i}$$

256-point data, for example, is produced by using a string of 1, $\beta_1, \beta_2, \ldots, \beta_{2p}$, 0, 0, . . . , 0. Then, 256-point FFT is done, with the frequency response of the amplitude being $$rms[i] = \sqrt{re \cdot {}^2[i] + Im \cdot {}^2[i]}$$

where 0≦i≦128. From this, $$wh_0[i] = \frac{\sqrt{re^2[i] + Im^2[i]}}{\sqrt{re \cdot {}^2[i] + Im \cdot {}^2[i]}}$$

where 0≦i≦128. This is found for each of corresponding points of the L-dimensional vector. If the number of points of the FFT is small, linear interpolation should be used, however, the closest value is herein found by:

$$wh[i] = wh_0\left[nint\left(\frac{128}{L} \cdot i\right)\right]$$

where 1≦i≦L. If a matrix having these as diagonal elements is W', $$W = \begin{bmatrix} wh(1) & & & 0 \\ & wh(2) & & \\ & & \ddots & \\ 0 & & & wh(L) \end{bmatrix} \tag{26}$$

The equation (26) represents the same matrix as the equation (24).

Alternatively, $|H(e^{jw})W(e^{jw})$ may directly be found from the equation (25) with respect to W=i/Lλ so as to be used for wh[i]. Still alternatively, an impulse response of the equation (25) is found a suitable length, such as for 64 points, and FFTed to find amplitude frequency characteristics which may then be used for wh[i].

Rewriting the equation (21) using this matrix, which is the frequency response of the weighted synthesis filter, we obtain the equation (27):

$$E=\|W\ (\underline{x}-g_L((\underline{s}_{0i}+\underline{s}_{1j}))\|^2 \tag{27}$$

The method for learning the shape codebook and the gain codebook is explained below.

The expected value of the distortion is minimized for all frames k for which a code vector $\underline{s}\mathbf{0}_c$ is selected for CB0. If there are M such frames, it suffices if $$J = \frac{1}{M} \sum_{k=1}^{M} \|W_k(\underline{xk} - g_k(\underline{s}_{0c} + \underline{s}_{1k}))\|^2 \tag{28}$$

is minimized. In the equation (28), W'k, $\underline{X}_k$, $g_k$ and $\underline{s}_{ik}$ denote the weighting for the k'th frame, an input to the k'th frame, the gain of the k'th frame and an output of the codebook CB0 for the k'th frame, respectively.

For minimizing the equation (28), $$J = \frac{1}{M}\sum_{k=1}^{M}\{(\underline{x}_k^T - g_k(\underline{s}_{0c}^T + \underline{s}_{1k}^T))W_k'^TW_k'(\underline{x}_k - g_k(\underline{s}_{0c} + \underline{s}_{1k}))\} \tag{29}$$

$$= \frac{1}{M}\sum_{k=1}^{M}\{\underline{x}_k^TW_k'^TW_k'\underline{x}_k - 2g_k(\underline{s}_{0c}^T + \underline{s}_{1k}^T)W_k'^TW_k'\underline{x}_k + g_k^2(\underline{s}_{0c}^T + \underline{s}_{1k}^T)W_k'^TW_k'(\underline{s}_{0c} + \underline{s}_{1k})\}$$

$$= \frac{1}{M}\sum_{k=1}^{M}\{\underline{x}_k^TW_k'^TW_k'\underline{x}_k - 2g_k(\underline{s}_{oc}^T + \underline{s}_{1k}^T)W_k'^TW_k'\underline{x}_k + g_k^2\underline{s}_{oc}^TW_k'\underline{s}_{oc} + 2g_k^2\underline{s}_{oc}^TW_k'^TW_k'\underline{s}_{1k} + g_k^2\underline{s}_{1k}^TW_k'^TW_k'\underline{s}_{1k}\}$$

$$\frac{\partial J}{\partial \underline{s}_{0c}} = \frac{1}{M}\sum_{k=1}^{M}\{-2g_kW_k'^TW_k'\underline{x}_k + 2g_k^2W_k'^TW_k'\underline{s}_{0c} + 2g_k^2W_k'^TW_k'\underline{s}_{1k}\} = 0 \tag{30}$$

Hence, $$\sum_{k=1}^{M}(g_kW_k^TW_k\underline{x}_k - g_k^2W_k^TW_k\underline{s}_{1k}) = \sum_{k=1}^{M}g_k^2W_k^TW_k\underline{s}_{0c} \tag{31}$$

so that $$s_{0c} = \left\{\sum_{k=1}^{M}g_k^2W_k^TW_k\right\}^{-1}\cdot\left\{\sum_{k=1}^{M}g_kW_k^TW_k(\underline{xk} - g_k\underline{s}_{1k})\right\}$$

where { } denotes an inverse matrix and $W_k'^T$ denotes a transposed matrix of $W_k'$.

Next, gain optimization is considered.

The expected value of the distortion concerning the k'th frame selecting the code word gc of the gain is given by:

$$J_g = \frac{1}{M}\sum_{k=1}^{N}\|W_k(\underline{x}_k - g_c(\underline{s}_{0k} + \underline{s}_{1k}))\|^2$$

$$= \frac{1}{M}\sum_{k=1}^{M}\{\underline{x}_k^TW_k^TW_k\underline{x}_k - 2g_c\underline{x}_k^TW_k^TW_k(\underline{s}_{0k} + \underline{s}_{1k}) - g_c^2(\underline{s}_{0k}^T + \underline{s}_{1k}^T)W_k^TW_k(\underline{s}_{0k} + \underline{s}_{1k})\}$$

Solving $$\frac{\partial J_g}{\partial g_c} = \frac{1}{M}\sum_{k=1}^{M}\{-2\underline{x}_k^TW_k^TW_k(\underline{s}_{0k} + \underline{s}_{1k}) - 2g_c(\underline{s}_{0k}^T + \underline{s}_{1k}^T)W_k^TW_k(\underline{s}_{0k} + \underline{s}_{1k})\} = 0$$

we obtain $$\sum_{k=1}^{M}\underline{x}_k^TW_k^TW_k(\underline{s}_{0k} + \underline{s}_{1k}) = \sum_{k=1}^{M}g_c(\underline{s}_{0k}^T + \underline{s}_{1k})W_k^TW(\underline{s}_{0k} + \underline{s}_{1k}) \tag{32}$$

and $$g_c = \frac{\sum_{k=1}^{M}\underline{x}_k^TW_k^TW_k(\underline{s}_{0k} + \underline{s}_{1k})}{\sum_{k=1}^{M}(\underline{s}_{0k}^T + \underline{s}_{1k}^T)W_k^TW(\underline{s}_{0k} + \underline{s}_{1k})}$$

The above equations (31) and (32) give optimum centroid conditions for the shape $\underline{s}_{0i}$, $\underline{s}_{1j}$, and the gain gi for $0 \leqq i \leqq 31$, that is an optimum decoder output. Meanwhile, $\underline{s}_{1i}$ may be found in the same way as for $\underline{s}_{0i}$.

The optimum encoding condition, that is the nearest neighbor condition, is considered.

The above equation (27) for finding the distortion measure, that is $\underline{s}_{0i}$ and $\underline{s}_{1i}$ minimizing the equation $E=\|W'(X-g\mathbf{1}(\underline{s}_{1i}+\underline{s}_{1j}))\|^2$, are found each time the input $\underline{X}$ and the weight matrix W' are given on the frame-by-frame basis.

Intrinsically, E is found on the round robin fashion for all combinations of g1 ($0 \leqq l \leqq 31$), $\underline{s}_{0i}$ ($0 \leqq i \leqq 31$) and $\underline{s}_{0j}$ ($0 \leqq i \leqq 31$), that is 32×32×32=32768, in order to find the set of $\underline{s}_{0i}$, $\underline{s}_{1i}$ which will give the minimum value of E. However, since this requires voluminous calculations, the shape and the gain are sequentially searched in the present embodiment. Meanwhile, round robin search is used for the combination of $\underline{s}_{0i}$ and $\underline{s}_{1j}$. There are 32×32=1024 combinations for $\underline{s}_{0i}$ and $\underline{s}_{1j}$. In the following description, $\underline{s}_{1i}+\underline{s}_{1j}$ are indicated as $\underline{s}_m$ for simplicity.

The above equation (27) becomes $E=\|W'(X-glsm)\|^2$. If, for further simplicity, $\underline{X}_w=W'\underline{X}$ and $\underline{s}_w=W'\underline{s}_m$, we obtain $$E = \|\underline{x}_w - g_L\underline{s}_w\|^2 \tag{33}$$

$$E = \|\underline{x}_w\|^2 + \|\underline{s}_w\|^2\left(g_1 - \frac{\underline{x}_w^T\cdot\underline{s}_w}{\|\underline{s}_w\|^2}\right)^2 - \frac{(\underline{x}_w^T\cdot\underline{s}_w)^2}{\|\underline{s}_w\|^2} \tag{34}$$

Therefore, if g1 can be made sufficiently accurate, the search can be performed in two steps of:

(1) searching for $\underline{s}_w$ which will maximize $$\frac{(\underline{x}_w^T\cdot\underline{s}_w)^2}{\|\underline{s}_w\|^2}$$

and (2) searching for gL which is closest to $$\frac{\underline{x}_w^T\cdot\underline{s}_w}{\|\underline{s}_w\|^2}$$

If the above are rewritten using the original notation, then:

(1)' searching is made for a set of $\underline{s}_{0i}$ and $\underline{s}_{1i}$ which will maximize $$\frac{(\underline{x}^TW^TW(\underline{s}_{0i} + \underline{s}_{1j}))^2}{\|W(\underline{s}_{0i} + \underline{s}_{1j})\|^2} \tag{35}$$

or (2)' searching is made for $g_L$ which is closest to $$\frac{\underline{x}^TW^TW(\underline{s}_{0i} + \underline{s}_{1j})}{\|W(\underline{s}_{0i} + \underline{s}_{1j})\|^2}$$

The above equation (35) represents an optimum encoding condition that is, the nearest neighbor condition.

Using the conditions (centroid conditions) of the equations (31) and (32) and the condition of the equation (35), codebooks (CB0, CB1, and CBg) can be trained simultaneously with use of the so-called generalized Lloyd algorithm (GLA).

Meanwhile, the weighting W' used for perceptual weighting at the time of vector quantization by the vector quantizer 116, is defined by the above equation (26). The weighting W' taking into account the temporal masking, however, can be found by finding the current weighting WI in which past W' has been taken into account.

The values of wh(1), wh(2), . . . , wh(L) in the above equation (26), as found at the time n, that is, at the n'th frame, are indicated as whn(1), whn(2), . . . , whn(L), respectively.

If the weights at time n, taking past values into account, are defined as An(i), where $1 \leqq i \leqq L$, $$\begin{aligned} An(i) &= \lambda A_{n-1}(i) + (1-\lambda)whn(i), \ (whn(i) \leqq A_{n-1}(i)) \\ &= whn(i), \ (whn(i) > A_{n-1}(i)) \end{aligned}$$

where $\lambda$ may be set to, for example, $\lambda=0.2$. In An(i), with $1 \leqq i \leqq L$, thus found, a matrix having such An(i) as diagonal elements may be used as the above weighting.

The shape index values $\underline{s}_{0i}$, $\underline{s}_{1j}$, obtained by the weighted vector quantization in this manner, are fed out at output terminals 520, 522, respectively, while the gain index gl is fed out at an output terminal 521. Also, the quantized value $\underline{X}_0'$ is fed out at the output terminal 504, while being sent to the adder 505.

The adder 505 subtracts the quantized value from the spectral envelope vector $\underline{X}$ to generate a quantization error vector $\underline{Y}$. Specifically, this quantization error vector $\underline{Y}$ is sent to the vector quantization unit 511 so as to be dimensionally split and quantized by vector quantizers $\mathbf{511}_1$ to $\mathbf{511}_8$ with weight vector quantization.

The second vector quantization unit 510 uses a larger number of bits than the first vector quantization unit 500. Consequently, the memory capacity of the codebook and the processing volume (complexity) for codebook searching are increased significantly. Thus it becomes impossible to carry out vector quantization with the 44-order which is the same as that of the first vector quantization unit 500. Therefore, the vector quantization unit 511 in the second vector quantization unit 510 is made up of plural vector quantizers and the input quantized values are dimensionally split into plural low-dimensional vectors for performing weighted vector quantization.

The relation between the quantized values $\underline{Y}_0$ to $\underline{Y}_7$, used in the vector quantizers $\mathbf{511}_1$ to $\mathbf{511}_8$, the number of dimensions and the number of bits are shown in the following Table 2.

TABLE 2

| quantized value | dimension | number of bits |
|---|---|---|
| $Y_0$ | 4 | 10 |
| $Y_1$ | 4 | 10 |
| $Y_2$ | 4 | 10 |
| $Y_3$ | 4 | 10 |
| $Y_4$ | 4 | 9 |
| $Y_5$ | 8 | 8 |
| $Y_6$ | 8 | 8 |
| $Y_7$ | 8 | 7 |

The index values $Id_{vq0}$ to $Id_{vq7}$ output from the vector quantizers $\mathbf{511}_1$ to $\mathbf{511}_8$ are fed out output terminals $\mathbf{523}_1$ to $\mathbf{523}_8$. The sum of the bits of these index data is 72.

If a value obtained by connecting the output quantized values $\underline{Y}_0'$ to $\underline{Y}_7'$ of the vector quantizers $\mathbf{511}_1$ to $\mathbf{511}_8$ in the dimensional direction is $\underline{Y}'$, the quantized values $\underline{Y}'$ and $\underline{X}_0'$ are summed by the adder 513 to give a quantized value $\underline{X}_1'$. Therefore, the quantized value $\underline{X}_1'$ is represented by $$\begin{aligned} \underline{X}_1' &= \underline{X}_0' + \underline{Y}' \\ &= \underline{X} - \underline{Y} + \underline{Y}' \end{aligned}$$

That is, the ultimate quantization error vector is $\underline{Y}'-\underline{Y}$.

If the quantized value $\underline{X}_1'$ from the second vector quantizer 510 is to be decoded, the speech signal decoding apparatus is not in need of the quantized value $\underline{X}_1'$ from the first quantization unit 500, however, it is in need of index data from the first quantization unit 500 and the second quantization unit 510.

The learning method and code book search in the vector quantization section 511 will be hereinafter explained.

As for the learning method, the quantization error vector $\underline{Y}$ is divided into eight low-order vectors $\underline{Y}_0$ to $\underline{Y}_7$, using the weight W', as shown in Table 2. If the weight W' is a matrix having 44point sub-sampled values as diagonal elements:

$$W = \begin{bmatrix} wh(1) & & & 0 \\ & wh(2) & & \\ & & \ddots & \\ 0 & & & wh(44) \end{bmatrix} \tag{36}$$

the weight W' is split into the following eight matrices:

$$W_1 = \begin{bmatrix} wh(1) & & 0 \\ & \ddots & \\ 0 & & wh(4) \end{bmatrix}$$

$$W_2 = \begin{bmatrix} wh(5) & & 0 \\ & \ddots & \\ 0 & & wh(8) \end{bmatrix}$$

$$W_3 = \begin{bmatrix} wh(9) & & 0 \\ & \ddots & \\ 0 & & wh(12) \end{bmatrix}$$

$$W_4 = \begin{bmatrix} wh(13) & & 0 \\ & \ddots & \\ 0 & & wh(16) \end{bmatrix}$$

$$W_5 = \begin{bmatrix} wh(17) & & 0 \\ & \ddots & \\ 0 & & wh(20) \end{bmatrix}$$

$$W_6 = \begin{bmatrix} wh(21) & & 0 \\ & \ddots & \\ 0 & & wh(28) \end{bmatrix}$$

$$W_7 = \begin{bmatrix} wh(29) & & 0 \\ & \ddots & \\ 0 & & wh(36) \end{bmatrix}$$

$$W_8 = \begin{bmatrix} wh(37) & & 0 \\ & \ddots & \\ 0 & & wh(44) \end{bmatrix}$$

Y and W', thus split in low dimensions, are termed $Y_i$ and $W_i'$, where $1 \leqq i \leqq 8$, respectively.

The distortion measure E is defined as $$E=\|W_i'(\underline{Y}_i-\underline{s})\|^2 \tag{37}$$

The codebook vector $\underline{s}$ is the result of quantization of $\underline{Y}_i$, and the code vector of the codebook minimizing the distortion measure E is searched for.

In the codebook learning, further weighting is done using the general Lloyd algorithm (GLA). The optimum centroid condition for learning is first explained. If there are M input vectors $\underline{Y}$ which have selected the code vector $\underline{s}$ as the optimum quantization result, and the training data is $\underline{Y}_k$, the expected value of distortion J is given by the equation (38) minimizing the center of distortion on weighting with respect to all frames k:

$$\begin{aligned} J &= \frac{1}{M}\sum_{k-1}^{M}\|W_k(\underline{Y}_k-\underline{s})\|^2 \\ &= \frac{1}{M}\sum_{k-1}^{M}(\underline{Y}_k-\underline{s})^T W_k^T W_k(\underline{Y}_k-\underline{s}) \\ &= \frac{1}{M}\sum_{k-1}^{M}\underline{Y}_k^T W_k^T W_k\underline{Y}_k - 2\underline{Y}_k^T W_k^T W_k\underline{s} + \\ &\quad \underline{s}^T W_k^T W_k\underline{s} \\ \frac{\partial J}{\partial \underline{s}} &= \frac{1}{M}\sum_{k-1}^{M}(-2\underline{T}_k^T W_k^T W_k + 2\underline{s}^T W_k^T W_k) = 0 \end{aligned} \tag{38}$$

Solving, we obtain $$\sum_{k=1}^{M}\underline{Y}_k^T W_k^T W_k = \sum_{k=1}^{M}\underline{s}^T W_k^T W_k$$

Taking transposed values of both sides, we obtain $$\sum_{k=1}^{M}W_k W_k^T\underline{Y}_k = \sum_{k=1}^{M}W_k^T W_k\underline{s}$$

Therefore, $$\underline{s} = \left(\sum_{k=1}^{M}W_k^T W_k\right)^{-1}\sum_{k=1}^{M}W_k^T W_k\underline{Y}_k$$

In the above equation (39), s is an optimum representative vector and represents an optimum centroid condition.

As for the optimum encoding condition, it suffices to search for $\underline{s}$ minimizing the value of $|W_i'(\underline{Y}_i-\underline{s})\|^2$. $W_i'$ during searching need not be the same as $W_i'$ during learning and may be non-weighted matrix:

$$\begin{bmatrix} 1 & & & & & 0 \\ & 1 & & & & \\ & & \cdot & & & \\ & & & \cdot & & \\ & & & & \cdot & \\ 0 & & & & & 1 \end{bmatrix}.$$

By constituting the vector quantization unit 116 in the speech signal encoder by two-stage vector quantization units, it becomes possible to render the number of output index bits variable.

Figure 9:
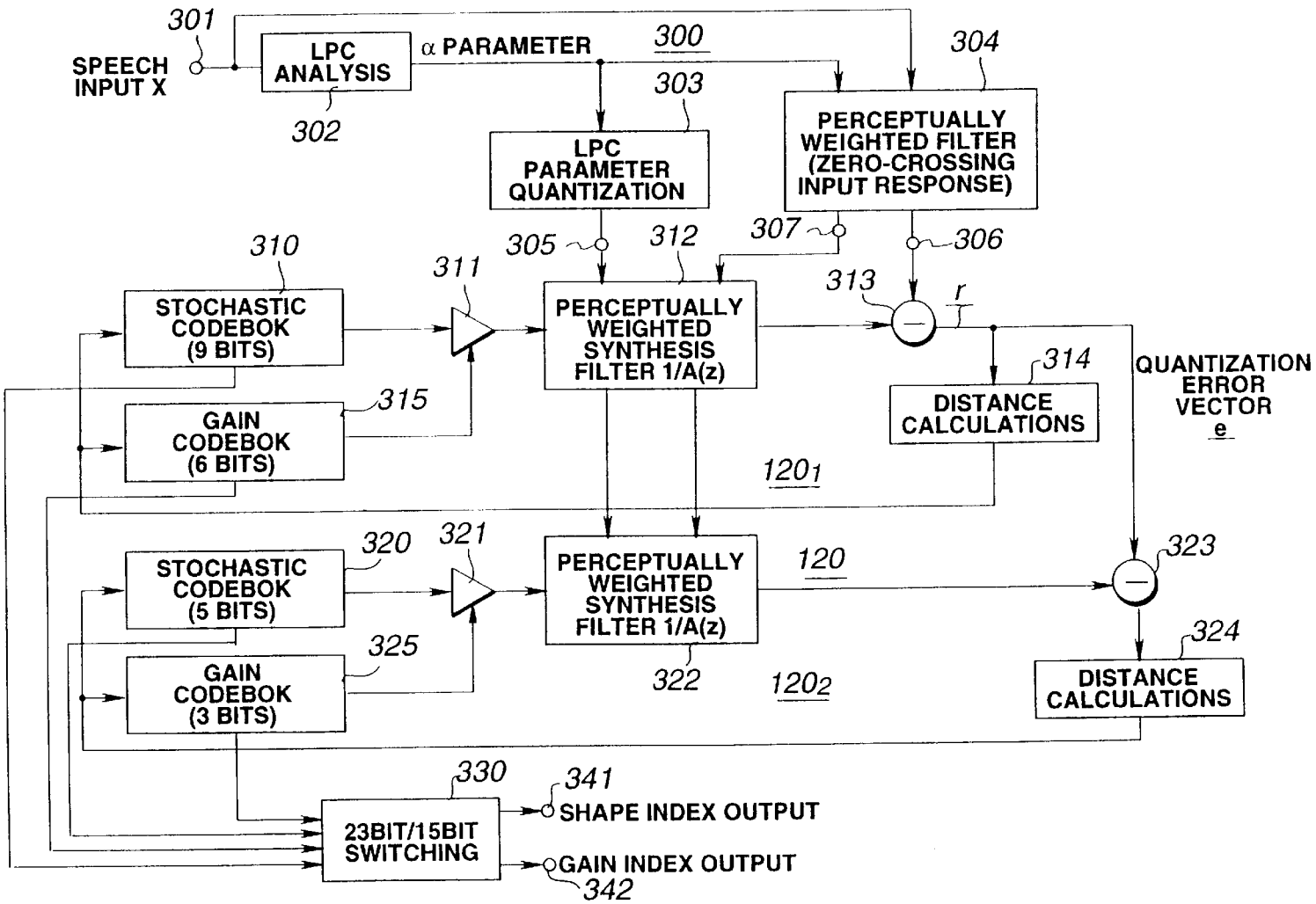
FIG. 9 is a block diagram showing in detail a CELP encoding portion forming a second encoding unit of the speech signal encoder according to an embodiment of the present invention.

The second encoding unit 120 employing the above-mentioned CELP encoder constitution of the present invention, is comprised of multi-stage vector quantization processors as shown in FIG. 9. These multi-stage vector quantization processors are formed as two-stage encoding units $\mathbf{120}_1$, $\mathbf{120}_2$ in the embodiment of FIG. 9, in which an arrangement for coping with the transmission bit rate of 6 kbps in case the transmission bit rate can be switched between 2 kbps and 6 kbps, is shown. In addition, the shape and gain index output can be switched between 23 bits/5 msec and 15 bits/5 msec. The processing flow in the arrangement of FIG. 9 is shown in FIG. 10.

Referring to FIG. 9, an LPC analysis circuit 302 of FIG. 9 corresponds to the LPC analysis circuit 132 shown in FIG. 3, while an LSP parameter quantization circuit 303 corresponds to the constitution from the a to LSP conversion circuit 133 to the LSP to α conversion circuit 137 of FIG. 3 and a perceptually weighted filter 304 corresponds to the perceptual weighting filter calculation circuit 139 and the perceptually weighted filter 125 of FIG. 3. Therefore, in FIG. 9, an output which is the same as that of the LSP to α conversion circuit 137 of the first encoding unit 113 of FIG. 3 is supplied to a terminal 305, while an output which is the same as the output of the perceptually weighted filter calculation circuit 139 of FIG. 3 is supplied to a terminal 307 and an output which is the same as the output of the perceptually weighted filter 125 of FIG. 3 is supplied to a terminal 306. In distinction from the system of FIG. 3, however, the perceptually weighted filter 304 of FIG. 9 generates the perceptually weighed signal that is the same signal as the output of the perceptually weighted filter 125 of FIG. 3, using the input speech data and pre-quantization α-parameter, instead of using an output of the LSP-α conversion circuit 137.

In the two-stage second encoding units $\mathbf{120}_1$ and $\mathbf{120}_2$, shown in FIG. 9, subtractors 313 and 323 correspond to the subtractor 123 of FIG. 3, while the distance calculation circuits 314, 324 correspond to the distance calculation circuit 124 of FIG. 3. In addition, the gain circuits 311, 321 correspond to the gain circuit 126 of FIG. 3, while stochastic codebooks 310, 320 and gain codebooks 315, 325 correspond to the noise codebook 121 of FIG. 3.

Figure 10:
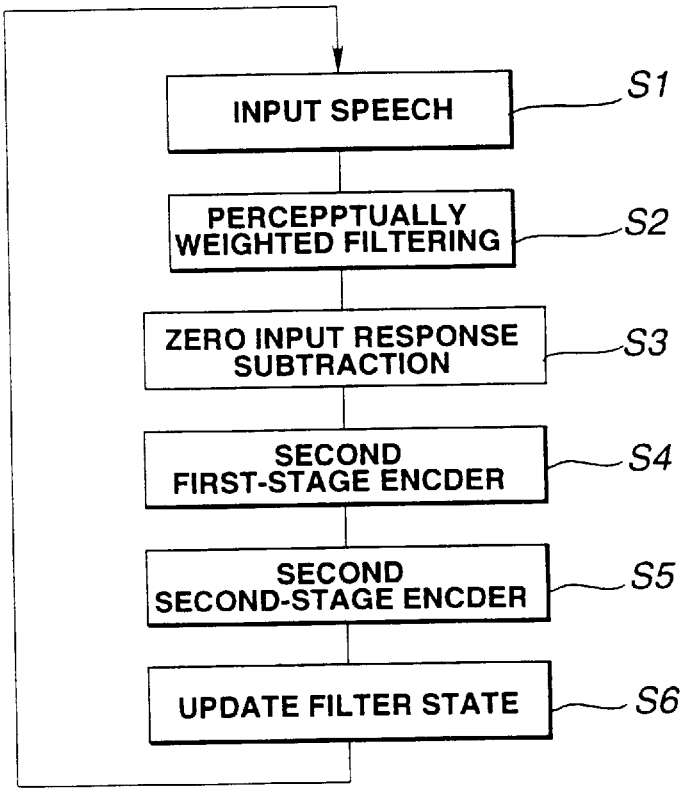
FIG. 10 is a flow chart for illustrating the processing flow of the encoding arrangement of FIG. 9.

In the constitution of FIG. 9, the LPC analysis circuit 302 at step S1 of FIG. 10 splits input speech data $\underline{x}$ supplied from a terminal 301 into frames as described above to perform LPC analyses in order to find an α-parameter. The LSP parameter quantization circuit 303 converts the α-parameter from the LPC analysis circuit 302 into LSP parameters to quantize the LSP parameters. The quantized LSP parameters are interpolated and converted into α-parameters. The LSP parameter quantization circuit 303 generates an LPC synthesis filter function 1/H (z). from the α-parameters converted from the quantized LSP parameters and sends the generated LPC synthesis filter function 1/H (z) to a perceptually weighted synthesis filter 312 of the first-stage second encoding unit $\mathbf{120}_1$ via terminal 305.

The perceptual weighting filter 304 finds data for perceptual weighting, which is the same as that produced by the perceptually weighting filter calculation circuit 139 of FIG. 3, from the α-parameter from the LPC analysis circuit 302, that is, the pre-quantization α-parameter. These weighting data are supplied via terminal 307 to the perceptually weighting synthesis filter 312 of the first-stage second encoding unit $\mathbf{120}_1$. The perceptual weighting filter 304 generates the perceptually weighted signal, which is the same signal as that output by the perceptually weighted filter 125 of FIG. 3, from the input speech data and the pre-quantization α-parameter, as shown at step S2 in FIG. 10. That is, the LPC synthesis filter function W(z) is first generated from the pre-quantization α-parameter. The filter function W(z) thus generated is applied to the input speech data $\underline{x}$ to generate $\underline{x}w$ which is supplied as the perceptually weighted signal via terminal 306 to the subtractor 303 of the first-stage second encoding unit $\mathbf{120}_1$.

In the first-stage second encoding unit $\mathbf{120}_1$, a representative value output of the stochastic codebook 310 of the 9-bit shape index output is sent to the gain circuit 311 which then multiplies the representative output from the stochastic codebook 310 with the gain (scalar) from the gain codebook 315 of the 6-bit gain index output. The representative value output, multiplied with the gain by the gain circuit 311, is sent to the perceptually weighted synthesis filter 312 with 1/A(z)=(1/H(z))*W(z). The weighting synthesis filter 312 sends the 1/A(z) zero-in put response output to the subtractor 313, as indicated at step S3 of FIG. 10. The subtractor 313 performs subtraction on the zero-input response output of the perceptually weighting synthesis filter 312 and the perceptually weighted signal $\underline{x}w$ from the perceptual weighting filter 304 and the resulting difference or error is taken out as a reference vector $\underline{r}$. During searching at the first-stage second encoding unit $\mathbf{120}_1$, this reference vector $\underline{r}$ is sent to the distance calculating circuit 314 where the distance is calculated and the shape vector $\underline{s}$ and the gain g minimizing the quantization error energy E are searched, as shown at step S4 in FIG. 10. Here, 1/A(z) is in the zero state. That is, if the shape vector $\underline{s}$ in the codebook synthesized with 1/A(z) in the zero state is $\underline{s}_{syn}$, the shape vector $\underline{s}$ and the gain g minimizing the equation (40):

$$E = \sum_{n=0}^{N-1} (\underline{r}(n) - g\underline{s}_{syn}(n))^2 \tag{40}$$

are searched.

Although $\underline{s}$ and g minimizing the quantization error energy E may be full-searched, the following method may be used for reducing the amount of calculations.

The first method is to search the shape vector $\underline{s}$ minimizing $E_s$ defined by the following equation (41):

$$E_s = \frac{\sum_{n=0}^{N-1} \underline{r}(n)\underline{s}_{syn}(n)}{\sqrt{\sum_{n=0}^{N-1} \underline{s}_{syn}(n)^2}}$$

From $\underline{s}$ obtained by the first method, the ideal gain is as shown by the equation (42):

$$g_{ref} = \frac{\sum_{n=0}^{N-1} \underline{r}(n)\underline{s}_{syn}(n)}{\sum_{n=0}^{N-1} \underline{s}_{syn}(n)^2} \tag{42}$$

Therefore, as the second method, the value of g minimizing the equation (43):

$$Eg=(g_{ref}-g)^2 \tag{43}$$

is searched. Since E is a quadratic function of g, such g minimizing Eg also minimizes E.

From $\underline{s}$ and g obtained by the first and second methods, the quantization error vector $\underline{e}$(n) can be calculated by the following equation (44):

$$e(n)=\underline{r}(n)-g\underline{s}_{syn}(n) \tag{44}$$

That is, quantized as a reference of the second-stage second encoding unit $\mathbf{120}_2$ as in the first stage.

More specifically, the signal supplied to the terminals 305 and 307 are directly supplied from the perceptually weighted synthesis filter 312 of the first-stage second encoding unit $\mathbf{120}_1$ to a perceptually weighted synthesis filter 322 of the second stage second encoding unit $\mathbf{120}_2$. The quantization error vector $\underline{e}$(n) found by the first-stage second encoding unit $\mathbf{120}_1$ is supplied to a subtractor 323 of the second-stage second encoding unit $\mathbf{120}_2$.

At step S5 of FIG. 10, processing similar to that performed in the first stage occurs in the second-stage second encoding unit $\mathbf{120}_2$. That is, a representative value output from the stochastic codebook 320 of the 5-bit shape index output is sent to the gain circuit 321 where the representative value output of the codebook 320 is multiplied with the gain from the gain codebook 325 of the 3-bit gain index output. An output of the weighted synthesis filter 322 is sent to the subtractor 323 where a difference between the output of the perceptually weighted synthesis filter 322 and the first-stage quantization error vector $\underline{e}$(n) is found. This difference is sent to a distance calculation circuit 324 for distance calculation in order to search the shape vector $\underline{s}$ and the gain g minimizing the quantization error energy E.

The shape index output of the stochastic codebook 310, the gain index output of the gain codebook 315 of the first-stage second encoding unit $\mathbf{120}_1$, the index output of the stochastic codebook 320, and the index output of the gain codebook 325 of the second-stage second encoding unit $\mathbf{120}_2$ are sent to an index output switching circuit 330. If 23 bits are output from the second encoding unit 120, the index data of the stochastic codebooks 310, 320 and the gain codebooks 315, 325 of the first-stage and second-stage second encoding units $\mathbf{120}_1$, $\mathbf{120}_2$ are summed and output. If 15 bits are output, the index data of the stochastic codebook 310 and the gain codebook 315 of the first-stage second encoding unit $\mathbf{120}_1$ are output.

The filter state is then updated for calculating a zero input response output, as shown at step S6.

In the present embodiment, the number of index bits of the second-stage second encoding unit $\mathbf{120}_2$ is as small as 5 for the shape vector, that for the gain is as small as 3. If suitable shape and gain are not present in this case in the codebook, the quantization error is likely to be increased, instead of being decreased.

Although 0 may be provided in the gain for preventing such defect, there are only three bits for the gain. If one of these is set to 0, the quantizer performance is significantly deteriorated. Taking this into consideration, an all-0 vector is provided for the shape vector to which a larger number of bits have been allocated. The above-mentioned search is performed, with the exclusion of the all-zero vector, and the all-zero vector is selected if the quantization error has ultimately been increased. The gain is arbitrary. This makes it possible to prevent the quantization error from being increased in the second-stage second encoding unit $\mathbf{120}_2$.

Although the two-stage arrangement has been described above, the number of stages may be larger than 2. In such case, if the vector quantization by the first-stage closed-loop search has come to a close, quantization of the N'th stage, where $2 \leqq N$, is carried out with the quantization error of the (N−1)st stage as a reference input, and the quantization error of the N'th stage is used as a reference input to the (N+1)st stage.

It is seen from FIG. 9 and 10 that, by employing multi-stage vector quantizers for the second encoding unit, the amount of calculations is decreased as compared to that with the use of a straight vector quantization with the same number of bits or with the use of a conjugate codebook. In particular, in CELP encoding in which vector quantization of the time-axis waveform employing the closed-loop search by the analysis by synthesis method, a smaller number of times of search operations is crucial. In addition, the number of bits can be easily switched by switching between employing both index outputs of the two-stage second encoding units $\mathbf{120}_1$, $\mathbf{120}_2$ and employing only the output of the first-stage second encoding unit $\mathbf{120}_1$ without employing the output of the second-stage second encoding unit $\mathbf{120}_1$. If the index outputs of the first-stage and second-stage second encoding units $\mathbf{120}_1$, $\mathbf{120}_2$ are combined and output, the decoder can easily cope with the configuration by selecting one of the index outputs. That is, That is, the decoder can easily cope with the configuration by decoding the parameter encoded with, for example, 6 kbps using a decoder operating at 2 kbps. In addition, if zero-vector is contained in the shape codebook of the second-stage second encoding unit $\mathbf{120}_2$, it becomes possible to prevent the quantization error from being increased with less deterioration in performance than if 0 is added to the gain.

The code vector of the stochastic codebook, for example, can be generated by clipping the so-called Gaussian noise. Specifically, the codebook may be generated by generating the Gaussian noise, clipping the Gaussian noise with a suitable threshold value, and normalizing the clipped Gaussian noise.

There are a variety of types in the speech, however, for example, the Gaussian noise can cope with speech of consonant sounds close to noise, such as "sa, shi, su, se, and so", while the Gaussian noise cannot cope with the speech of acutely rising consonants, such as "pa, pi, pu, pe, and po". According to the present invention, the Gaussian noise is applied to some of the code vectors, while the remaining portion of the code vectors is dealt with by learning, so that both the consonants having sharply rising consonant sounds and the consonant sounds close to the noise can be coped with. If, for example, the threshold value is increased, a vector is obtained that has several larger peaks, whereas if the threshold value is decreased the code vector is approximate to the Gaussian noise. Thus, by increasing the variation in the clipping threshold value, it becomes possible to cope with consonants having sharp rising portions, such as "pa, pi, pu, pe, and po" or consonants close to noise, such as "sa, shi, su, se, and so", thereby increasing clarity.

Figure 11A:
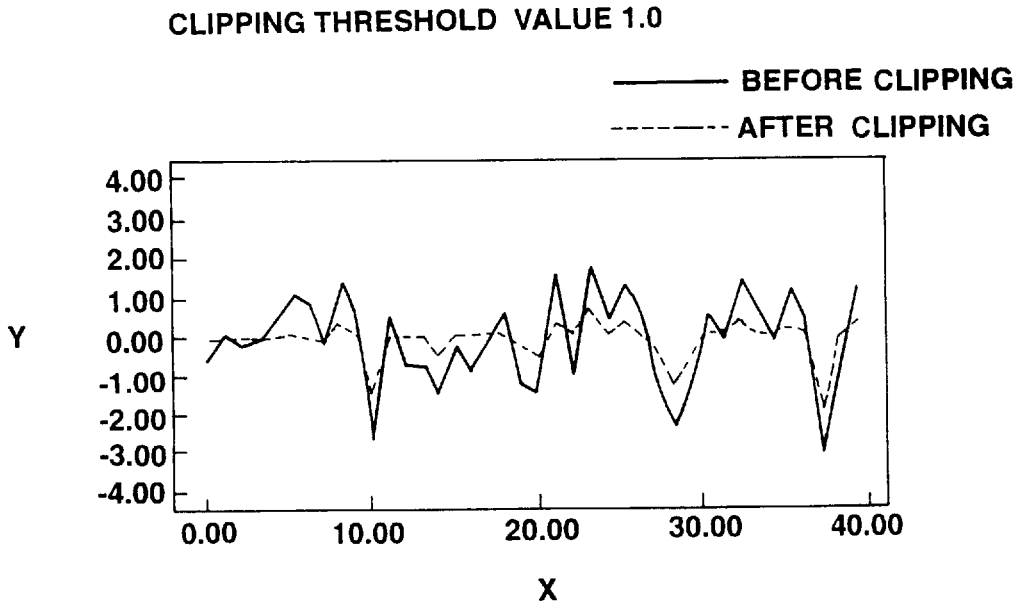
FIG. 11A and 11B illustrate the Gaussian noise after clipping at different threshold values.
Figure 11B:
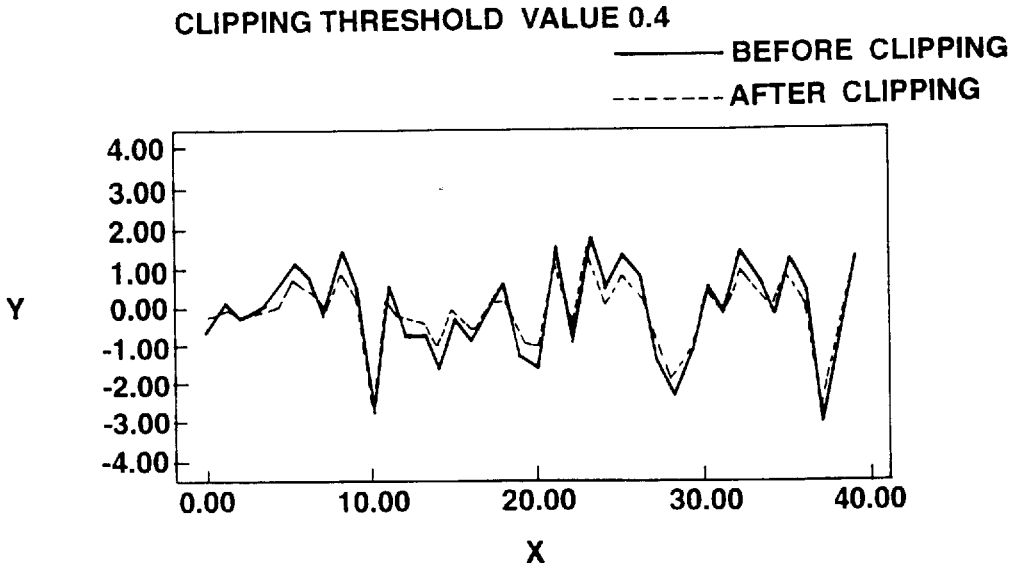

FIGS. 11A and 11B show the appearance of the Gaussian noise and the clipped noise by a solid line and by a broken line, respectively. FIGS. 11A and 11B show the noise with the clipping threshold value equal to 1.0, that is, with a larger threshold value, and the noise with the clipping threshold value equal to 0.4, that is with a smaller threshold value. It is seen from FIGS. 11A and 11B that, if the threshold value is selected to be larger, there is obtained a vector having several larger peaks, whereas, if the threshold value is selected to a smaller value, the noise approaches to the Gaussian noise itself.

For realizing this, an initial codebook is prepared by clipping the Gaussian noise and a suitable number of non-learning code vectors are set. The non-learning code vectors are selected in the order of the increasing variance value for coping with consonants close to the noise, such as "sa, shi, su, se, and so". The vectors found by learning use the LBG algorithm for learning. The encoding under the nearest neighbor condition uses both the fixed code vector and the code vector obtained on learning. In the centroid condition, only the code vector set for learning is updated. Thus, the code vector set for learning can cope with sharply rising consonants, such as "pa, pi, pu, pe, and po".

An optimum gain may be learned for these code vectors by the usual learning process.

Figure 12:
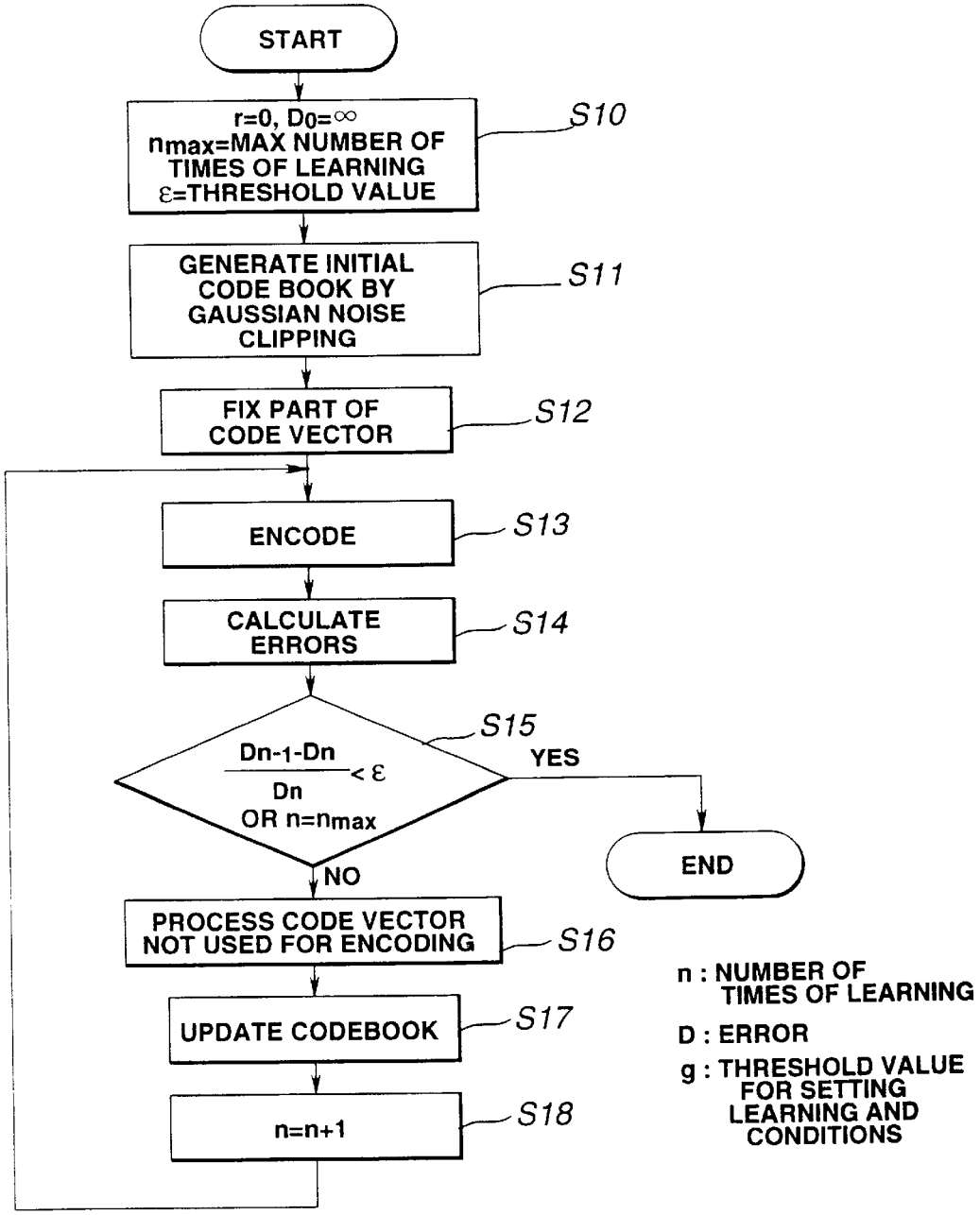
FIG. 12 is a flowchart showing the processing flow at the time of generating the shape codebook by learning.

FIG. 12 shows the processing flow for the constitution of the codebook by clipping the Gaussian noise.

In FIG. 12, the number of times of learning n is set to n=0 at step S10 for initialization. With an error $D_0=\infty$, the maximum number of times of learning $n_{max}$ is set and a threshold value $\epsilon$ setting the learning end condition is set.

At the next step S11, the initial codebook is generated by clipping the Gaussian noise. At step S12, part of the code vectors is fixed as non-learning code vectors.

At the next step S13, encoding is done using the above codebook. At step S14, the error is calculated. At step S15, it is judged if $(D_{n-1}-D_n/D_n<\epsilon$, or $n=n_{max}$. If the result is YES, the processing is terminated. If the result is NO, the processing transfers to step S16.

At step S16, the code vectors that were not used for encoding are processed. At the next step S17, the codebooks are updated. At step S18, the number of times of learning n is incremented before returning to step S13.

Figure 13:
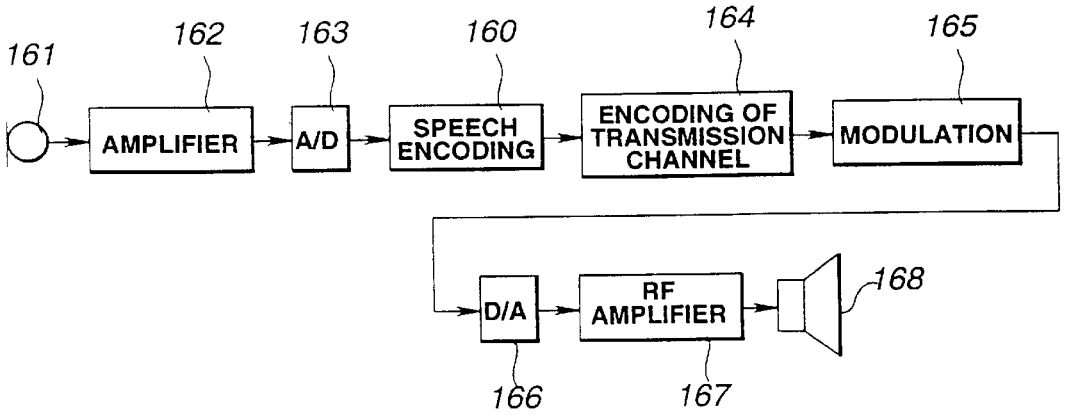
FIG. 13 is a block diagram of a transmission side of a portable terminal employing a speech signal encoder embodying the present invention.
Figure 14:
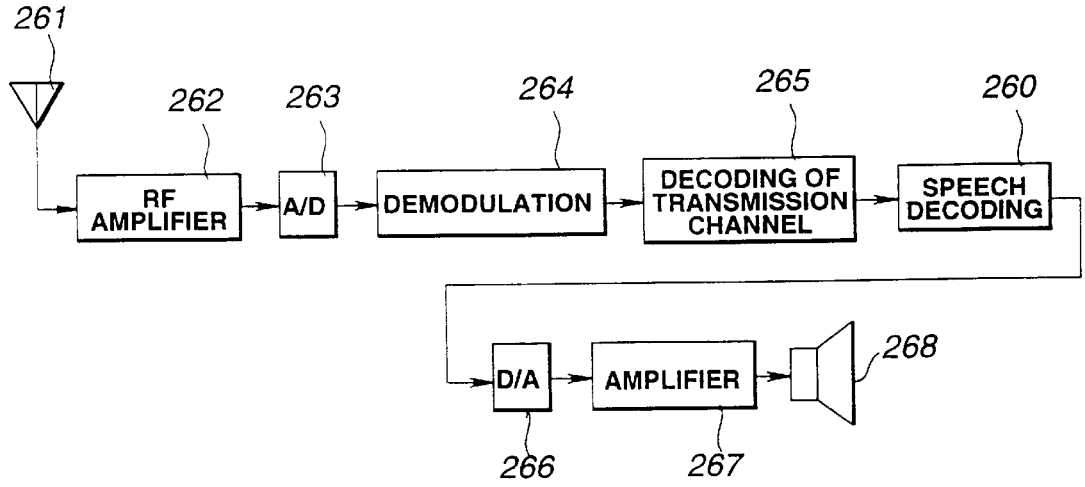
FIG. 14 is a block diagram showing a structure of a receiving side of the portable terminal employing the speech signal decoder and which is a counterpart of the system of FIG. 13.

The above-described signal encoding and signal decoding apparatus may be used as a speech codebook employed in, for example, a portable communication terminal or a portable telephone set, as shown in FIGS. 13 and 14.

FIG. 13 shows a transmitting side of a portable communication terminal employing a speech encoding unit 160 configured as shown in FIGS. 1 and 3. The speech signals collected by a microphone 161 are amplified by an amplifier 162 and converted by an analog/digital (A/D) converter 163 into digital signals which are sent to the speech encoding unit 160 configuration as shown in FIGS. 1 and 3. That is, the digital signals from the A/D converter 163 are supplied to the input terminal 101 in FIGS. 1 and 3, and the speech encoding unit 160 performs encoding as explained in connection with FIGS. 1 and 3. Output signals of output terminals of FIGS. 1 and 3 are sent as output signals of the speech encoding unit 160 to a transmission channel encoding unit 164, which then performs channel coding on the supplied signals. Output signals of the transmission channel encoding unit 164 are sent to a modulation circuit 165 for modulation and thence supplied to an antenna 168 via a digital/analog (D/A) converter 166 and an RF amplifier 167.

FIG. 14 shows a reception side of a portable terminal employing a speech decoding unit 260 configured as shown in FIG. 4. The speech signals received by the antenna 261 of FIG. 14 are amplified an RF amplifier 262 and sent via an analog/digital (A/D) converter 263 to a demodulation circuit 264, from which demodulated signal are sent to a transmission channel decoding unit 265. An output signal of the decoding unit 265 is supplied to a speech decoding unit 260 configured as shown in FIGS. 2 and 4. The speech decoding unit 260 decodes the signals as explained in connection with FIGS. 2 and 4. That is, the output signal at terminal 201 of FIGS. 2 and 4 is the output signal of the speech decoding unit 260 fed to a digital/analog (D/A) converter 266. The analog speech signals from the D/A converter 266 are sent to a speaker 268 to be listened to by the user of the portable communication terminal.

It is understood, of course, that the preceding was presented by way of example only and is not intended to limit the spirit or scope of the present invention, which is to be defined only by the appended claims.

What is claimed is:

1. A speech encoding method for an input speech signal divided on the time axis into blocks as units and for encoding the divided signal on a block-by-block basis, comprising the steps of:

finding short-term prediction residuals at least for a voiced portion of the input speech signal;

finding sinusoidal analytic encoding parameters based on the short-term prediction residuals thus found;

performing perceptually weighted vector quantization for each harmonic magnitude on the sinusoidal analytic encoding parameters to produce an encoded voiced portion of the input speech signal; and encoding an unvoiced portion of the input speech signal by waveform encoding to produce an encoded unvoiced portion of the input speech signal.

2. The speech signal encoding method as claimed in claim 1 wherein it is judged whether the input speech signal is voiced or unvoiced and, based on the results of judgment, the portion of the input speech signal found to be voiced is processed with said sinusoidal analytic encoding and the portion of the input speech signal found to be unvoiced is vector quantized by a closed-loop optimum vector search using an analysis-by-synthesis method.

3. The speech signal encoding method as claimed in claim 1 wherein one of the analytic encoding parameters comprises data representing a spectral envelope that is used as the sinusoidal analysis parameter used in the step of performing perceptually weighted vector quantization.

4. The speech encoding method as claimed in claim 1 wherein the step of performing perceptually weighted vector quantization includes: at least comprising:

performing a first vector quantization operation on the input speech signal; and performing a second quantization step of quantizing a quantization error vector produced at the time of performing said first vector quantization.

5. The speech signal encoding method as claimed in claim 4 wherein for a low bit rate an output of the first vector quantization step is taken out, and for a high bit rate an output of said first vector quantization step and an output of said second vector quantization step are taken out.

6. A speech encoding apparatus receiving an input speech signal divided on the time axis into blocks for encoding the divided signal on a block-by-block basis, comprising:

means for finding short-term prediction residuals of at least a voiced portion of the input speech signal;

means for finding sinusoidal analytic encoding parameters including a spectral harmonic magnitude envelope from the short-term prediction residuals thus found;

means for performing perceptually weighted vector quantization at least on the spectral harmonic magnitude envelope; and means for encoding an unvoiced portion of the input speech signal by waveform encoding.

7. A speech encoding apparatus receiving an input speech signal divided on the time axis into blocks for encoding the signal on a block-by-block basis, comprising:

means for finding short-term prediction residuals at least for a voiced portion of the input speech signal;

means for finding linear spectral pairs of encoding parameters including a spectral magnitude harmonic envelope from the short-term prediction residuals; and means performing perceptually weighted multiple-stage vector quantization on the linear spectral pairs of encoding parameters limited in the frequency axis.

8. A portable radio terminal device comprising:

amplifying means for amplifying input speech signals;

A/D converting means for A/D conversion of the amplified speech signals;

speech encoding means for encoding a speech signal output from said A/D converting means;

transmission path encoding means for channel encoding the encoded speech signal;

modulating means for modulating an output of said transmission path encoding means;

D/A converting means for D/A converting the resulting modulated signal to an analog signal; and amplifier means for amplifying the analog signal from said D/A converting means and supplying the resulting amplified signal to an antenna, wherein said speech encoding means includes means for finding a short-term prediction residual of at least a voiced portion of said input speech signal;

means for finding sinusoidal analytic encoding parameters from the short-term prediction residuals thus found;

means for performing perceptually weighted vector quantization on said sinusoidal analytic encoding parameters; and means for encoding an unvoiced portion of said input speech signal by waveform encoding.

* * * * *